US009820903B2

(12) United States Patent
Steffens et al.

(10) Patent No.: US 9,820,903 B2
(45) Date of Patent: Nov. 21, 2017

(54) METHOD AND SYSTEM FOR TURNING AND POSITIONING A PATIENT

(71) Applicant: Sage Products, LLC, Cary, IL (US)

(72) Inventors: Jeff Steffens, Cary, IL (US); Paul Fowler, Rockford, IL (US); Larry Ponsi, Wheeling, IL (US); David Beck, Crystal Lake, IL (US); Greg Davis, Crystal Lake, IL (US)

(73) Assignee: Sage Products, LLC, Cary, IL (US)

( * ) Notice: Subject to any disclaimer, the term of this patent is extended or adjusted under 35 U.S.C. 154(b) by 0 days.

(21) Appl. No.: 14/317,663

(22) Filed: Jun. 27, 2014

(65) Prior Publication Data

US 2014/0304918 A1 Oct. 16, 2014

Related U.S. Application Data

(63) Continuation of application No. 13/014,500, filed on Jan. 26, 2011, now Pat. No. 8,789,533.

(51) Int. Cl.
*A61G 7/057* (2006.01)
*A61G 7/10* (2006.01)
(Continued)

(52) U.S. Cl.
CPC ..... *A61G 7/015* (2013.01); *A61G 7/001* (2013.01); *A61G 7/057* (2013.01);
(Continued)

(58) Field of Classification Search
CPC ..... A61G 7/00; A61G 7/001; A61G 7/002; A61G 7/005; A61G 7/015; A61G 7/057;
(Continued)

(56) References Cited

U.S. PATENT DOCUMENTS 1,334,901 A 3/1920 Higdon
3,333,286 A 8/1967 Biolik
(Continued)

FOREIGN PATENT DOCUMENTS

DE 102010007457 A1 8/2011
FR 2923367 5/2009
(Continued)

OTHER PUBLICATIONS

Nov. 28, 2014—(EP) Search Report—App 14159820.1.
(Continued)

*Primary Examiner* — Keri J Nelson
(74) *Attorney, Agent, or Firm* — Foley & Lardner LLP

(57) ABSTRACT

A device for use with a bed having a frame and a supporting surface includes a flexible sheet with a tether strap connected to the sheet and extending from the sheet. The flexible sheet has opposed top and bottom surfaces, with the top surface having a high friction material with a higher coefficient of friction as compared to the bottom surface, which includes a low friction material. The tether strap is configured for connection to the frame of the bed to secure the sheet in place. A system incorporating the flexible sheet may also include an absorbent pad configured to be placed on the top surface of the sheet, where the high-friction top surface resists sliding of the absorbent pad, as well as one or more wedges having a base wall that the wedge rests on and a ramp surface configured to confront the sheet when the wedge is placed under the sheet. The base wall and the ramp surface may also contain high friction and low friction materials, respectively.

23 Claims, 8 Drawing Sheets

(51) Int. Cl.
*A61G 7/015* (2006.01)
*A61G 7/00* (2006.01)
*A61G 7/002* (2006.01)

(52) U.S. Cl.
CPC ..... *A61G 7/05715* (2013.01); *A61G 7/1025* (2013.01); *A61G 7/1026* (2013.01); *A61G 7/002* (2013.01); *A61G 7/05761* (2013.01)

(58) Field of Classification Search
CPC ..... A61G 7/05715; A61G 7/0573; A61G 7/1025; A61G 7/1026
USPC ..... 128/845; 5/81.1 R, 81.1 HS, 81.1 T
See application file for complete search history.

(56) References Cited

U.S. PATENT DOCUMENTS

| | | | | |
|---|---|---|---|---|
| 3,452,372 | A | 7/1969 | Emery | |
| 3,792,500 | A | 2/1974 | Swara, Sr. | |
| 3,829,914 | A * | 8/1974 | Treat | A47C 21/00 5/495 |
| 3,965,503 | A | 6/1976 | Gridel | |
| 4,048,681 | A | 9/1977 | Baulch et al. | |
| 4,214,326 | A | 7/1980 | Spann | |
| 4,233,700 | A | 11/1980 | Spann | |
| 4,391,010 | A * | 7/1983 | Kronman | A47G 9/0238 5/484 |
| 4,662,016 | A | 5/1987 | Seeman | |
| 4,675,925 | A | 6/1987 | Littleton | |
| 4,802,249 | A | 2/1989 | Bills | |
| 4,858,625 | A | 8/1989 | Cramer | |
| 5,138,731 | A | 8/1992 | Harcrow, Jr. | |
| 5,182,828 | A | 2/1993 | Alivizatos | |
| 5,193,238 | A | 3/1993 | Clute | |
| 5,280,657 | A * | 1/1994 | Stagg | A47G 9/04 5/496 |
| 5,329,655 | A | 7/1994 | Garner | |
| 5,448,790 | A | 9/1995 | Saro et al. | |
| RE35,468 | E | 3/1997 | Newman | |
| 6,154,900 | A | 12/2000 | Shaw | |
| 6,560,793 | B2 | 5/2003 | Walker | |
| 6,658,676 | B1 | 12/2003 | Persson et al. | |
| 6,666,426 | B1 * | 12/2003 | Taylor | A47C 21/026 248/506 |
| 6,804,845 | B2 | 10/2004 | Stewart, III et al. | |
| 6,874,176 | B2 | 4/2005 | Berge | |
| 7,240,384 | B2 | 7/2007 | DuDonis | |
| 7,506,387 | B1 | 3/2009 | Scordato et al. | |
| 7,571,498 | B2 | 8/2009 | Jewell et al. | |
| 7,676,862 | B2 * | 3/2010 | Poulos et al. | 5/430 |
| 7,849,533 | B1 | 12/2010 | Receveur et al. | |
| 8,161,583 | B1 | 4/2012 | Palen | |
| 8,789,533 | B2 | 7/2014 | Steffens et al. | |
| 2001/0040402 | A1 | 11/2001 | Odderson | |
| 2002/0029417 | A1 | 3/2002 | Walker | |
| 2004/0060113 | A1 | 4/2004 | Lantagne | |
| 2005/0005358 | A1 | 1/2005 | DuDonis | |
| 2005/0055768 | A1 | 3/2005 | Assink | |
| 2005/0229314 | A1 | 10/2005 | Chisari | |
| 2006/0213010 | A1 | 9/2006 | Davis | |
| 2010/0257703 | A1 | 10/2010 | Vass | |
| 2011/0072579 | A1 | 3/2011 | Receveur et al. | |
| 2011/0304186 | A1 | 12/2011 | Andrews | |
| 2012/0186587 | A1 | 7/2012 | Steffens et al. | |
| 2013/0205495 | A1 | 8/2013 | Ponsi et al. | |
| 2013/0270881 | A1 | 10/2013 | Fowler et al. | |
| 2014/0304918 | A1 | 10/2014 | Steffens et al. | |

FOREIGN PATENT DOCUMENTS

| | | | |
|---|---|---|---|
| GB | 2300845 | A | 11/1996 |
| WO | 8810082 | A1 | 12/1988 |
| WO | 9627357 | | 9/1996 |
| WO | 02065877 | A1 | 8/2002 |
| WO | 2004050002 | | 6/2004 |
| WO | WO-2005/107673 | | 11/2005 |
| WO | WO-2012/170934 | A2 | 12/2012 |

OTHER PUBLICATIONS

Dec. 4, 2012—(WO) International Search Report and Written Opinion—App PCT/US2012/041729.
May 15, 2014—(WO) International Search Report and Written Opinion—App PCT/US12/22572.
IPRP dated Dec. 10, 2013 from PCT/US2012/041729.
Jul. 12, 2013—(WO) International Search Report and Written Opinion—App PCT/US2013/036448.
Dec. 31, 2013—(U.S.) Final Office Action—U.S. Appl. No. 13/014,497.
Jul. 2, 2013—(U.S.) Non-Final Office Action—U.S. Appl. No. 13/014,497.
Mar. 20, 2013—(U.S.) Non-Final Office Action—U.S. Appl. No. 13/014,500.
May 15, 2015—(WO) International Search Report and Written Opinion—App PCT/US2014/067672.
Sep. 14, 2015—(U.S.) Non-Final Office Action—U.S. Appl. No. 13/838,952.
Communication pursuant to Article 94(3) EPC for EP Application No. 12728152.5 date Apr. 22, 2015, 5 pages.
Communication pursuant to Article 94(3) EPC for EP Application No. 12739957.4 dated Mar. 14, 2016, 6 pages.
Extended European Search Report for EP App. No. 17150121.6, dated Mar. 28, 2017, 6 pages.
Extended European Search Report for EP Application No. 12739957.4 dated Jun. 25, 2015, 7 pages.
Prism Medical Company, 5300 Ergoglide Instructions, 2009, 2 pp. Maryland Heights, MO.
Textbook of Palliative Nursing, Nov. 10, 2005, Oxford University Press, XP002740850, 1 page.
Waverley Glen, One-Way Glide—The Grimstead Range of Transfer and Repositioning Aids, Ontario Canada, downloaded Jun. 11, 2012, 3 pages.

* cited by examiner

FIG. 3
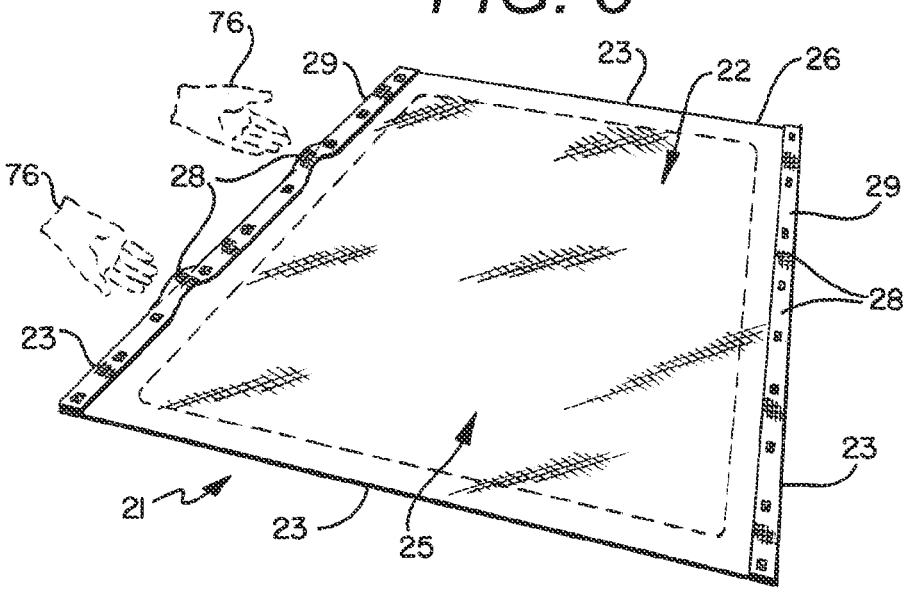
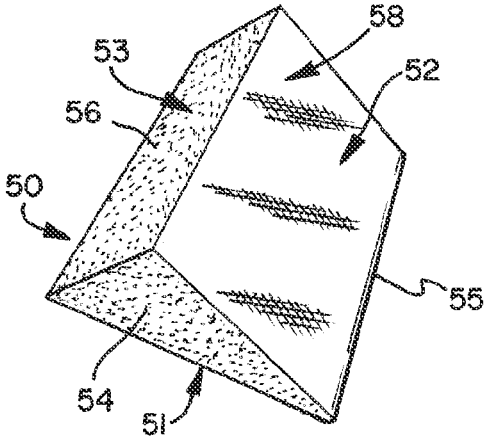
FIG. 4
FIG. 5
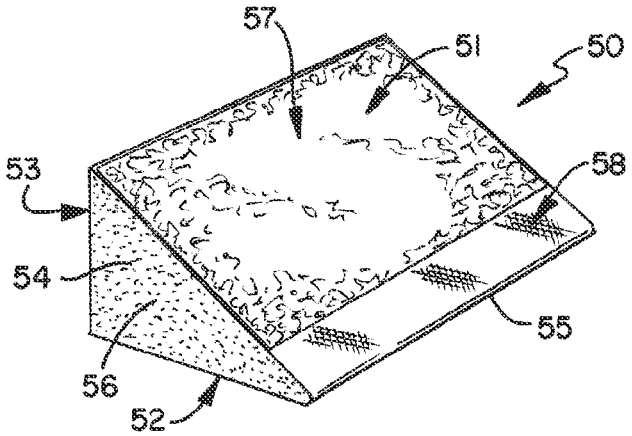

FIG. 10a
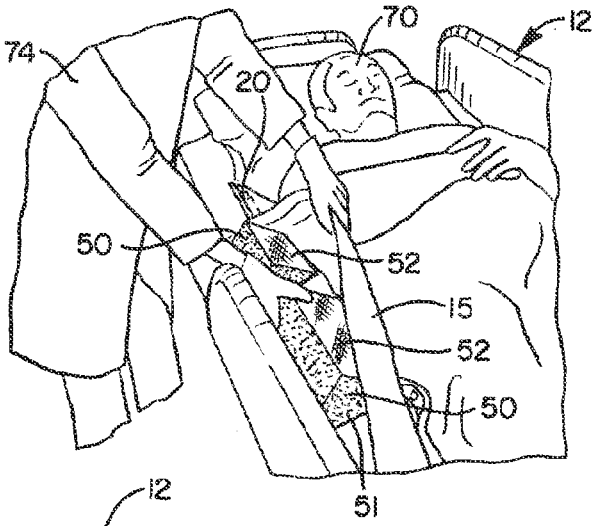
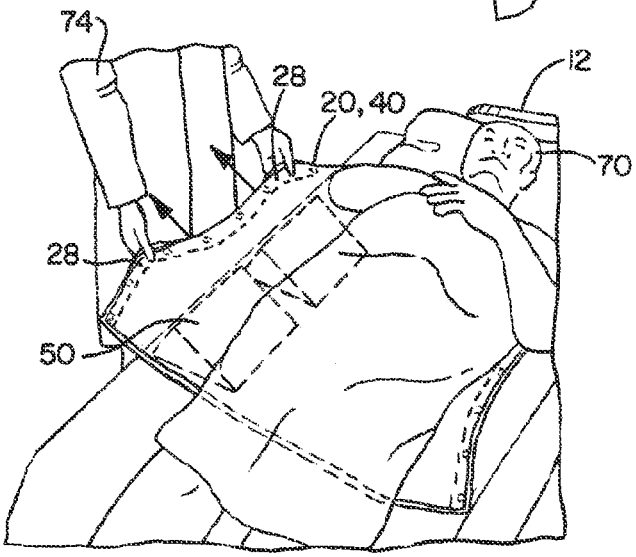
FIG. 10b
FIG. 10c
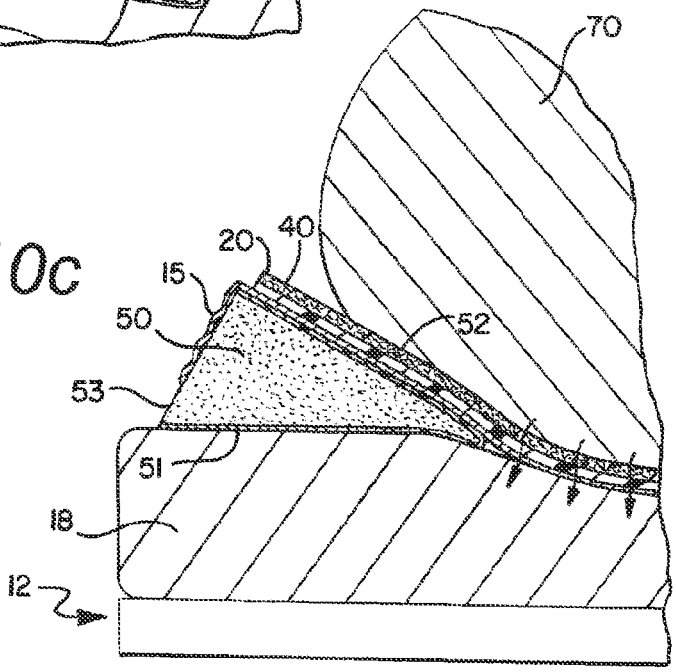

METHOD AND SYSTEM FOR TURNING AND POSITIONING A PATIENT

CROSS-REFERENCE TO RELATED APPLICATION

This application is a continuation of co-pending U.S. patent application Ser. No. 13/014,500, filed Jan. 26, 2011, which application is incorporated by reference herein in its entirety and made part hereof.

TECHNICAL FIELD

The present invention generally relates to an apparatus, system, and method for turning and positioning a person supine on a bed or the like, and, more particularly, to a sheet having a gripping surface, a slipping surface, an absorbent pad, and/or a wedge for use in turning and positioning a supine person, as well as systems and methods including one or more of such apparatuses.

BACKGROUND

Nurses and other caregivers at hospitals, assisted living facilities, and other locations often care for bedridden patients that have limited or no mobility, many of whom are critically ill or injured. These immobile patients are at risk for forming pressure ulcers (bed sores). Pressure ulcers are typically formed by one or more of several factors. Pressure on a patient's skin, particularly for extended periods of time and in areas where bone or cartilage protrudes close to the surface of the skin, can cause pressure ulcers. Frictional forces and shearing forces from the patient's skin rubbing or pulling against a resting surface can also cause pressure ulcers. Excessive heat and moisture can cause the skin to be more fragile and increase the risk for pressure ulcers. One area in which pressure ulcers frequently form is on the sacrum, because a patient lying on his/her back puts constant pressure on the sacrum, and sliding of the patient in a bed can also cause friction and shearing at the sacrum. Additionally, some patients need to rest with their heads inclined for pulmonary reasons, which can cause patients to slip downward in the bed and cause further friction or shearing at the sacrum and other areas. Existing devices and methods often do not adequately protect against pressure ulcers in bedridden patients, particularly pressure ulcers in the sacral region.

One effective way to combat sacral pressure ulcers is frequent turning of the patient, so that the patient is resting on one side or the other, and pressure is taken off of the sacrum. Pillows that are stuffed partially under the patient are often use to support the patient's body in resting on their left or right sides. A protocol is often used for scheduled turning of bedridden patients, and dictates that patients should be turned Q2, or every two hours, either from resting at a 30° angle on one side to a 30° angle on the other side, or from 30° on one side to 0°/supine (lying on his/her back) to 30° on the other side. However, turning patients is difficult and time consuming, typically requiring two or more caregivers, and can result in injury to caregivers from pushing and pulling the patient's weight during such turning. As a result, ensuring compliance with turning protocols, Q2 or otherwise, is often difficult. Additionally, the pillows used in turning and supporting the patient are non-uniform and can pose difficulties in achieving consistent turning angles, as well as occasionally slipping out from underneath the patient.

The present invention seeks to overcome certain of these limitations and other drawbacks of existing devices, systems, and methods, and to provide new features not heretofore available.

BRIEF SUMMARY

The present invention relates generally to systems for turning and positioning persons in a supine position, such as a patient in a hospital bed. Aspects of the invention relate to a device for use with a bed having a frame and a supporting surface supported by the frame, the device including a sheet having a bottom surface adapted to be placed above the supporting surface of the bed and a top surface opposite the bottom surface, and a tether strap connected to the sheet and extending from the sheet. The bottom surface of the sheet has a low friction surface forming at least a portion of the bottom surface, and the top surface has a high friction surface forming at least a portion of the top surface, such that the top surface provides greater slipping resistance than the bottom surface. The tether strap is configured for connection to the bed.

According to one aspect, the system further includes a support device configured to be placed below the bottom surface of the sheet to support the patient in an angled position. The support device may be a wedge having a wedge body formed at least partially of a foam or other compressible material and having a base wall, a ramp surface, and a back wall, the ramp surface joined to the base wall to form an apex and positioned at an angle of approximately 15-35 degrees to the base wall. The ramp surface has a low friction surface forming at least a portion of the ramp surface and the base wall has a high friction surface forming at least a portion of the base wall. The wedge may include a high friction material adhesively connected to the base wall to form the high friction surface and a low friction material adhesively connected to the ramp surface to form the low friction surface. The low friction material may be wrapped at least partially around the apex, such that the low friction material forms a portion of the base wall. The low friction surface of the sheet and the low friction surface of the wedge may formed of a same first material and the high friction surface of the sheet and the high friction surface of the wedge may likewise formed of a same second material. In one example, the system includes two such wedges.

According to another aspect, the tether strap includes an elastic portion, and may also include a non-elastic portion, where the elastic portion and the non-elastic portion each form a portion of a length of the tether strap. The elastic portion is connected at one end to the sheet and at another end to the non-elastic portion, and the non-elastic portion is configured for connection to a fastener on the bed. The non-elastic portion may be made from a material configured to function as a loop material in a hook-and-loop connecting structure. In this configuration, the non-elastic portion can be connected to the elastic portion by a hook-and-loop connection and is configured for connection to the fastener by a hook-and-loop connection. Additionally, the sheet may include a plurality of tether straps connected to the sheet and extending from the sheet, each of the tether straps being configured for connection to the frame of the bed.

According to a further aspect, the sheet has the bottom surface at least partially formed of a first material having a first coefficient of friction and the top surface at least partially formed of a second material having a second coefficient of friction. The second coefficient of friction is higher than the first coefficient of friction such that the top surface provides greater slipping resistance than the bottom surface. The first material may be a first piece of sheet material forming at least a majority portion of the bottom surface and the second material may be a second piece of sheet material connected to the first piece of sheet material and forming at least a majority portion of the top surface. In these embodiments, the first material forms the low friction surface and the second material forms the high friction surface.

According to yet another aspect, the system further includes a fastener strip having an adhesive portion adapted for adhesively connecting to the frame of the bed. The tether strap is releasably connectable to the fastener strip via hook and loop connection.

According to still further aspects, the sheet is breathable to allow passage of heat, air, and moisture vapor through the sheet.

According to additional aspects, the system further includes an absorbent pad configured to be positioned on top of the top surface of the sheet, such that the high friction surface resists sliding of the pad with respect to the top surface of the sheet. The absorbent pad may be made of a material that is different from the materials of the sheet, the wedge(s), and other components of the system.

Additional aspects of the invention relate to a system for use with a bed as described above that includes a sheet having a bottom surface adapted to be placed above the supporting surface of the bed and a top surface opposite the bottom surface, and a wedge including a wedge body formed at least partially of a compressible material and having a base wall, a ramp surface, and a back wall. The sheet includes a first material having a first coefficient of friction and a second material connected to the first material, the second material having a second coefficient of friction, where the first material forms at least a majority portion of the bottom surface and the second material forms at least a majority portion of the top surface. The second coefficient of friction is higher than the first coefficient of friction such that the top surface provides greater slipping resistance than the bottom surface. The wedge has the ramp surface joined to the base wall to form an apex and positioned at an angle of approximately 15-35 degrees to the base wall. The ramp surface is at least partially formed of a third material having a third coefficient of friction and the base wall is at least partially formed of a fourth material having a fourth coefficient of friction. The fourth coefficient of friction is higher than the third coefficient of friction. As described above, the first and third materials may be the same, and the second and fourth materials may be the same. The wedge is configured to be positioned under the sheet such that the base wall confronts the supporting surface of the bed and the ramp surface confronts the bottom surface of the sheet. The fourth material is adapted to resist sliding of the wedge with respect to the supporting surface of the bed, due to the higher fourth coefficient of friction.

Further aspects of the invention relate to a method for moving, turning, and/or positioning a patient on a bed as described above or other supporting surface. The method includes placing a sheet above the supporting surface of the bed, the sheet having a first edge positioned proximate a first side of the bed and a second edge positioned proximate a second side of the bed opposite the first side, and then positioning the patient above the supporting surface of the bed, such that at least a portion of the patient rests above the sheet. A support device is placed at least partially underneath the sheet, by inserting the support device underneath the first edge of the sheet from the first side of the bed. The first edge of the sheet is then moved toward the first side of the bed to slide the patient and at least a portion of the sheet at least partially up on top of the support device, such that the support device partially supports one side of the patient to cause the patient to lie in an angled position. The method may also include a second such support device, where moving the first edge of the sheet toward the first side of the bed slides the patient and at least a portion of the sheet up at least partially on top of the support device and the second support device, such that the support device partially supports one side of the upper body of the patient and the second support device partially supports one side of the lower body of the patient to cause the patient to lie in an angled position.

According to one aspect, the sheet has a bottom surface that confronts the supporting surface of the bed and a top surface opposite the bottom surface. The bottom surface has a low friction surface forming at least a portion of the bottom surface, and the top surface has a high friction surface forming at least a portion of the top surface, such that the top surface provides greater slipping resistance than the bottom surface.

According to another aspect, the method may further include placing an absorbent body pad over the sheet such that the body pad is positioned between the patient and the sheet, such that the high friction surface resists sliding of the body pad with respect to the top surface. The sheet and the body pad may be provided together in a folded arrangement, and are placed on the bed by simultaneously unfolding the sheet and the body pad. For example, the sheet and the body pad may be folded by first folding width-wise by folding the first and second edges of the sheet toward a center of the sheet along a plurality of length-wise fold lines, and are thereafter folding length-wise along at least one width-wise fold line. The sheet and the body pad can be simultaneously unfolded by first unfolding the sheet and the body pad along the at least one width-wise fold line to create a narrow, width-wise folded arrangement. Second, the patient is rolled toward the second side of the bed, and third, the width-wise folded arrangement is placed proximate the patient. The first edge of the sheet and the pad are then unfolded toward the first side of the bed to create an unfolded portion and a folded portion, and the patient is rolled toward the first side of the bed and onto the unfolded portion. Next, the second edge of the sheet and the pad are unfolded toward the second side of the bed to completely unfold the sheet and the pad, and the patient is rolled to a horizontal position on top of the sheet and the pad.

According to a further aspect, the sheet is connected to the bed by use of a tether strap extending from the sheet that is releasably connected to a frame of the bed.

According to yet another aspect, the shoulders of the patient are rotated less than approximately 45 degrees from a horizontal position during the step of moving the first edge of the sheet toward the first side of the bed.

According to an additional aspect, the support device may be a wedge having a base wall, a ramp surface positioned at an angle to the base wall to form an apex, and a back wall opposite the apex, and the support device can be placed at least partially underneath the sheet by inserting the apex of the wedge underneath an edge of the sheet from the first side of the bed such that the base wall confronts the supporting surface of the bed and the ramp surface confronts the sheet. The ramp surface of the wedge may have a low friction surface forming at least a portion of the ramp surface and the base wall of the wedge may have a high friction surface forming at least a portion of the base wall. In this configuration, the high friction surface has a higher coefficient of friction than the low friction surface, and the high friction surface resists sliding of the base wall against the bed due to the higher coefficient of friction.

Still other aspects of the invention relate to a method for moving, turning, and/or positioning a patient on a bed as described above or other supporting surface. The bed may include a frame and a mattress supported by the frame, and may have a head, a foot, and first and second opposed sides, and may also have a bed sheet covering a supporting surface of the mattress. A sheet is placed over the bed sheet, the sheet having a bottom surface that is placed in contact with the bed sheet (if present), and a top surface opposite the bottom surface. The bottom surface is at least partially formed of a first material having a first coefficient of friction, and the top surface is at least partially formed of a second material having a second coefficient of friction. The second coefficient of friction is higher than the first coefficient of friction such that the top surface provides greater slipping resistance than the bottom surface. The sheet further includes at least one first handle located on a first edge of the sheet and at least one second handle located on a second, opposed edge of the sheet. An absorbent pad is placed into contact with the top surface of the sheet, and the second material resists sliding of the pad with respect to the top surface, due to the higher second coefficient of friction. The patient is positioned above the supporting surface of the bed, such that at least a portion of the patient rests on the absorbent pad. Two wedges are placed at least partially under the bed sheet, one of the wedges being proximate an upper body of the patient and the other wedge being proximate the lower body of the patient. Each wedge includes a base wall, a ramp surface positioned at an angle to the base wall to form an apex, and a back wall opposite the apex, and is positioned by inserting the apex of the wedge under the sheet from the first side of the bed such that the base wall confronts the supporting surface of the mattress and the ramp surface confronts the sheet. The ramp surfaces of the wedges are at least partially formed of a third material having a third coefficient of friction and the base walls are at least partially formed of a fourth material having a fourth coefficient of friction. The base walls of the wedges resist sliding of the wedges due to the higher second coefficient of friction. The first edge of the sheet is then moved toward the back walls of the wedges by pulling on the at least one first handle to slide the patient and at least a portion of the sheet at least partially up the ramp surfaces of the wedges, such that the ramp surface of one wedge partially supports the upper body of the patient and the ramp surface of the other wedge partially supports the lower body of the patient, to cause the patient to lie in an angled position. Further, as described above, the bed may have a bed sheet covering the mattress, and the wedges may be placed underneath the edge of the bed sheet when inserting the wedges under the sheet.

According to one aspect, when the patient is lying in the angled position, the patient has shoulders that are rotated between approximately 20 and 30 degrees from a horizontal position.

According to another aspect, the wedges are spaced about 10 cm apart when placed at least partially underneath the bed sheet.

According to a further aspect, the method further includes removing the wedges from beneath the bed sheet and then placing the wedges at least partially under the other side of the bed sheet to turn the patient on the opposite side. One wedge is placed proximate the upper body of the patient, and the other wedge is placed proximate the lower body of the patient, by inserting the apex of each wedge under the second edge of the bed sheet from the second side of the bed, such that the base wall contacts the supporting surface of the mattress and the ramp surface contacts the bed sheet. The second edge of the sheet is then moved toward the back walls of the wedges by pulling on the at least one second handle to slide the patient and at least a portion of the sheet at least partially up the ramp surfaces of the wedges, such that the ramp surface of the one wedge partially supports the upper body of the patient and the ramp surface of the other wedge partially supports the lower body of the patient, to cause the patient to lie in a second angled position.

According to yet another aspect, the sheet further comprises a tether strap connected to the sheet and extending from the sheet, and the method further includes attaching the tether strap to a fastener on the frame of the bed. The fastener is located at the head of the bed such that the tether strap limits movement of the sheet with the patient thereon when the head of the bed is raised to an angle. The tether strap may include an elastic portion and may further include a non-elastic portion, such that the elastic and non-elastic portions each form at least a portion of the length of the tether strap. The elastic portion is connected at one end to the sheet and at another end to the non-elastic portion, and the non-elastic portion is attached to the fastener. The fastener may be a fastener strip having an adhesive portion and a hook-and-loop connecting structure, and the tether strap further comprises a complementary hook-and-loop connecting structure. In this configuration, the method may further include attaching the fastener strip to the frame at the head of the bed by use of the adhesive portion, and the tether strap is attached to the fastener strip by connecting the hook-and-loop connecting structures of the tether strap and the fastener strip.

Other features and advantages of the invention will be apparent from the following specification taken in conjunction with the following drawings.

BRIEF DESCRIPTION OF THE DRAWINGS

FIG. 3 is a bottom perspective view of the flexible sheet of FIG. 2;

FIG. 4 is a top perspective view of a wedge of the system of FIG. 1;

FIG. 5 is a bottom perspective view of a wedge of the system of FIG. 1;

FIGS. 10*a-c* are a sequential series of views illustrating a method of turning a patient to an angled resting position utilizing the system of FIG. 1, according to aspects of the invention.

DETAILED DESCRIPTION

Figure 1:
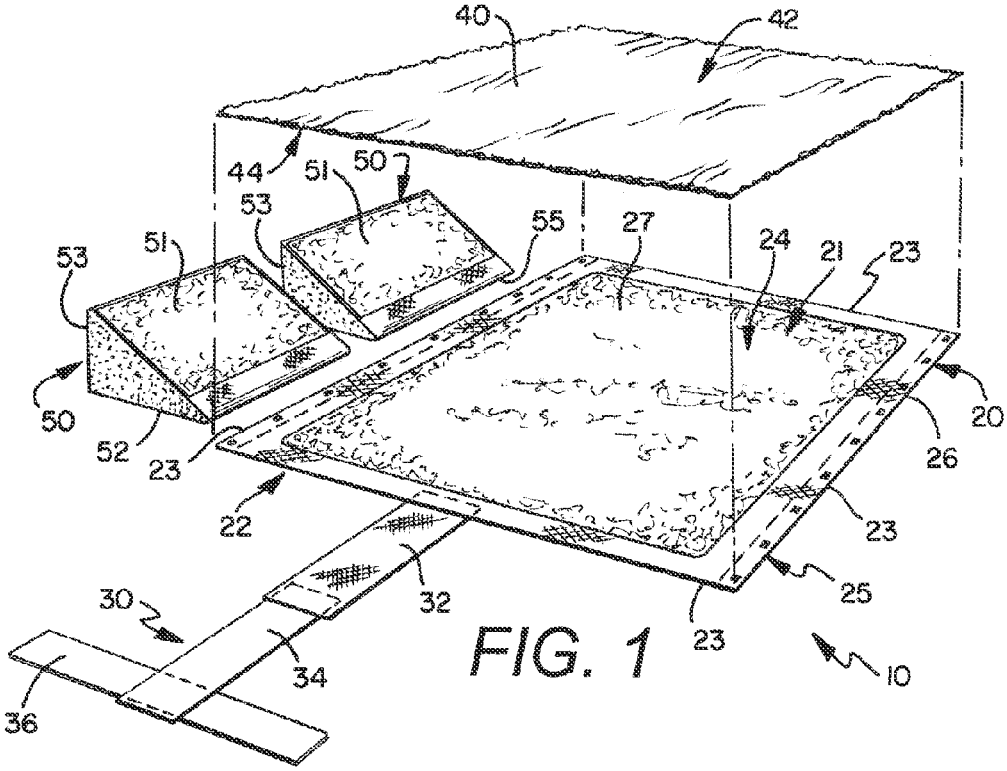
FIG. 1 is an exploded perspective view of one embodiment of a system for use in turning and positioning a patient, according to aspects of the invention.

While this invention is susceptible of embodiment in many different forms, there are shown in the drawings, and will herein be described in detail, preferred embodiments of the invention with the understanding that the present disclosure is to be considered as an exemplification of the principles of the invention and is not intended to limit the broad aspects of the invention to the embodiments illustrated and described.

In general, the invention relates to one or more apparatuses or devices, including a sheet having a high friction or gripping surface and a low friction or slipping surface, an absorbent body pad configured to be placed over the sheet, and one or more wedges configured to be placed underneath the sheet to support the patient in an angled position, as well as systems including one or more of such devices and methods utilizing one or more of such systems and/or devices. Various embodiments of the invention are described below.

Referring now to the figures, and initially to FIGS. 1-6, there is shown an exemplary embodiment of a system 10 for use in turning and positioning a person in a supine position, such as a patient lying on a hospital bed. As shown in FIG. 1, the system 10 includes a sheet 20, an absorbent body pad 40 configured to be placed over the sheet 20, and one or more wedges 50 configured to be placed under the sheet 20. The patient can be positioned on top of the body pad 40, with the body pad 40 lying on the sheet 20, and one or more wedges 50 optionally positioned underneath the sheet 20.

Figure 6:
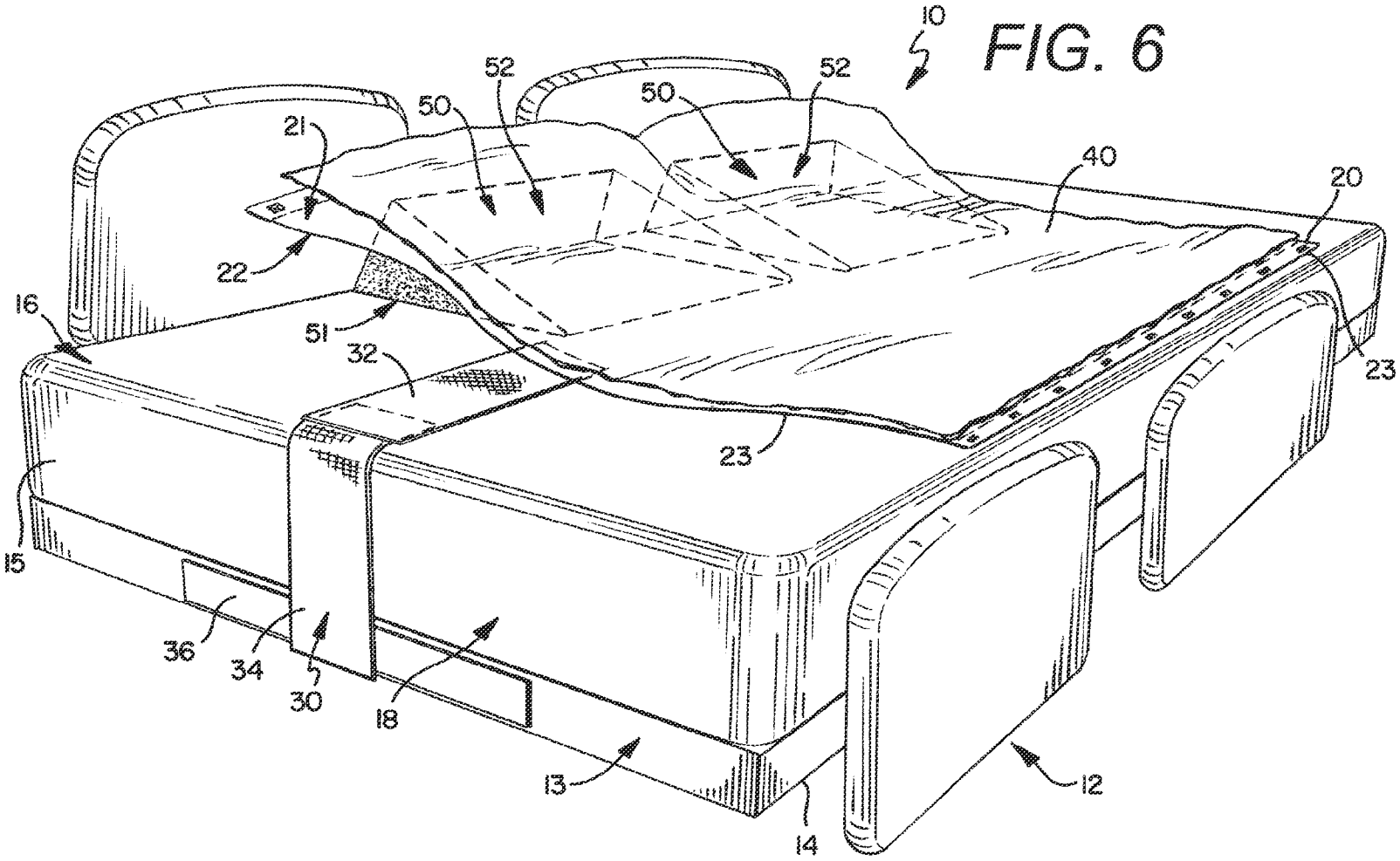
FIG. 6 is a perspective view of the system of FIG. 1 positioned on a bed.

As shown in FIG. 6, the system 10 is configured to be placed on a bed 12 or other support apparatus for supporting a person in a supine position. The bed 12 generally includes a frame 14 and a supporting surface 16 supported by the frame 14, as shown in FIG. 6. The supporting surface 16 can be provided by a mattress 18 or similar structure, and in various embodiments, the mattress 18 can incorporate air pressure support, alternating air pressure support and/or low-air-loss (LAL) technology. These technologies are known in the art, and utilize a pump motor or motors (not shown) to effectuate airflow into, over and/or through the mattress 18. The air aids in supporting the patient, and the top of the mattress 18 may be breathable so that the airflow can pull heat and moisture vapor away from the patient. The bed 12 may also include a bed sheet 15 (such as a fitted sheet or flat sheet), as shown in FIGS. 10*a-c*, as well as pillows, blankets, additional sheets, and other components known in the art. Further, the bed 12 may be an adjustable bed, such as a typical hospital-type bed, where the head 13 (or other parts) of the bed 12 can be raised and lowered, such as to incline the patient's upper body. It is understood that the system 10 and the components thereof can be used with other types of beds 12 as well.

Figure 2:
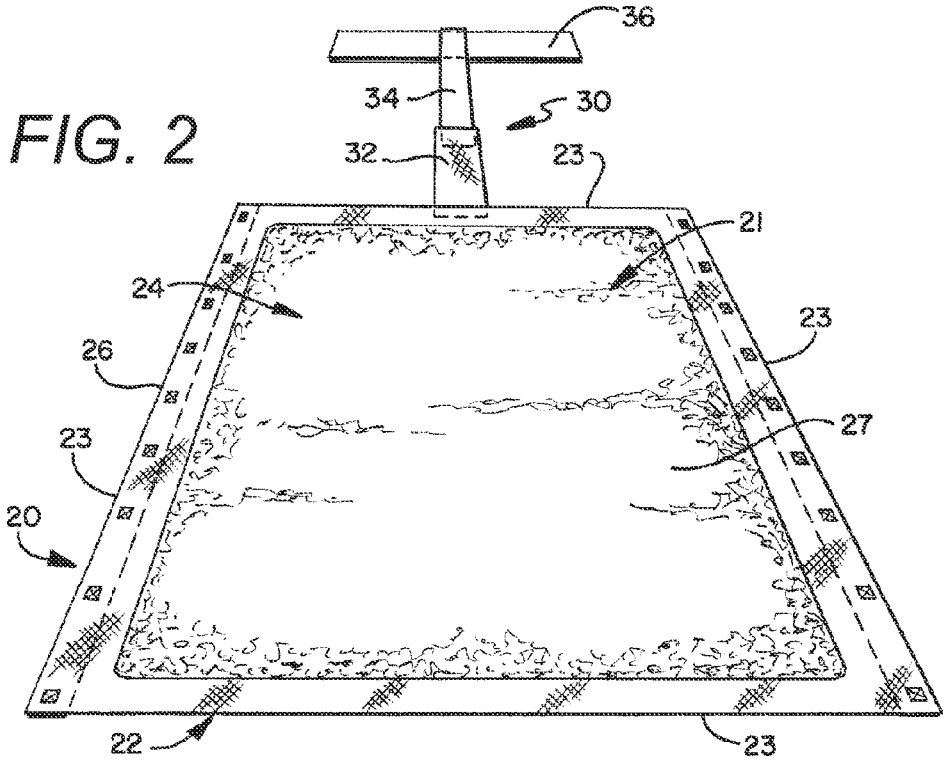
FIG. 2 is a top elevation view of a flexible sheet of the system of FIG. 1.

An example embodiment of the sheet 20 is shown in greater detail in FIGS. 2-3. In general, the sheet 20 is flexible and foldable, and has a top surface 21 and a bottom surface 22 defined by a plurality of peripheral edges 23. The sheet 20 is configured to be positioned on the bed 12 so that the bottom surface 22 is above the supporting surface 16 of the bed 12 and faces or confronts the supporting surface 16, and is supported by the supporting surface 16. As used herein, "above," "below," "over," and "under" do not imply direct contact or engagement. For example, the bottom surface 22 being above the supporting surface 16 means that that the bottom surface 22 may be in contact with the supporting surface 16, or may face or confront the supporting surface 16 and/or be supported by the supporting surface 16 with one or more structures located between the bottom surface 22 and the supporting surface 16, such as a bed sheet 15 as described above. Likewise, "facing" or "confronting" does not imply direct contact or engagement, and may include one or more structures located between the surface and the structure it is confronting or facing.

As seen in FIGS. 2-3, the sheet 20 in this embodiment is rectangular, having four peripheral edges 23, but could be a different shape in other embodiments. The top surface 21 has at least a portion formed of a high-friction or gripping material 24, and the bottom surface 22 has at least a portion formed of a low-friction or sliding material 25. In this embodiment, the sheet includes a first piece 26 of sheet material that is formed partially or entirely of the low-friction material 25, with a second piece 27 of sheet material that is formed partially or entirely of the high-friction material 24, with the second piece 27 connected to the first piece 26 in a surface-to-surface, confronting relation to form a layered structure. As illustrated in FIGS. 2-3, the first piece 26 is larger than the second piece 27, so that the first piece 26 forms the entire bottom surface 22 of the sheet 20, and the second piece 27 forms at least a majority portion of the top surface 21, with the edges of the second piece 27 being recessed from the edges 23 of the sheet 20. In other words, in this embodiment, the sheet 20 is primarily formed by the first piece 26, with the second piece 27 connected to the first piece 26 to form at least a part of the top surface 21. In another embodiment, the first piece 26 forms at least a majority portion of the bottom surface 22, and the second piece 27 forms at least a majority portion of the top surface 21. The pieces 26, 27 are connected by stitching in one embodiment, but may have additional or alternate connections in other embodiments, including adhesives, sonic welding, heat welding and other techniques, including techniques familiar to those skilled in the art. Additionally, the low-friction material 25 and/or the high-friction material 24 may be formed by multiple pieces in other embodiments. For example, the first piece 26 made of the low-friction material 25 may have a plurality of strips or patches of the high-friction material 24 connected on the top surface 21 in one embodiment. In a further embodiment, the high friction material 24 may be or include a coating applied to the low friction piece 26, such as a spray coating. As described in greater detail below, the low-friction material 25 permits sliding of the sheet 20 in contact with the supporting surface 16 of the bed 12, which may include a fitted bed sheet 15 or other sheet, and the high-friction material 24 provides increased resistance to slipping or sliding of the patient and/or the body pad 40 on which the patient may be lying, in contact with the sheet 20.

As shown in the embodiment in FIGS. 1-6, the first piece 26 is made substantially entirely of the low-friction material 25. In one embodiment, the low-friction material 25 is at least partially made from polyester and/or nylon (polyamide), although other materials can be used in addition to or instead of these materials. In one embodiment, the high friction material 24 is a warp knit tricot material that may be brushed, napped, and/or sanded to raise its pile, which can enhance comfort, and may be made of polyester and/or another suitable material. The material 24 can then be treated with a high friction substance, such as a hot melt adhesive or appropriate plastic, which can be applied as a discontinuous coating to promote breathability. The material 24 can also be treated with a water repellant, such as PTFE. In other embodiments, the high-friction material 24 may include any combination of these components, and may contain other components in addition to or instead of these components. Additionally, both the first and second pieces 26, 27 may be breathable in one embodiment, to allow passage of air, heat, and moisture vapor away from the patient.

Generally, the high friction material 24 has a coefficient of friction that is higher than the coefficient of friction of the low friction material 25. In one embodiment, the coefficient of friction for the high friction material 24 is about 8-10 times higher than the coefficient of friction of the low friction material 25. In another embodiment, the coefficient of friction for the high friction material 24 is between 5 and 10 times higher, or at least 5 times higher, than the coefficient of friction of the low friction material 25. The coefficient of friction, as defined herein, can be measured as a direct proportion to the pull force necessary to move either of the materials 24, 25 in surface-to-surface contact with the same third material, with the same normal force loading. Thus, in the embodiments above, if the pull force for the high friction material 24 is about 8-10 times greater than the pull force for the low friction material 25, with the same contact material and normal loading, the coefficients of friction will also be 8-10 times different. It is understood that the coefficient of friction may vary by the direction of the pull force, and that the coefficient of friction measured may be measured in a single direction. For example, in one embodiment, the above differentials in the coefficients of friction of the high friction material 24 and the low friction material 25 may be measured as the coefficient of friction of the low friction material 25 based on a pull force normal to the side edges 23 (i.e. proximate the handles 28) and the coefficient of friction of the high friction material 24 based on a pull force normal to the top and bottom edges 23 (i.e. parallel to the side edges 23).

Additionally, the coefficient of friction of the interface between the high-friction material 24 and the pad 40 is greater than the coefficient of friction of the interface between the low friction material 25 and the bed sheet 15 or supporting surface 16. It is understood that the coefficients of friction for the interfaces may also be measured in a directional orientation, as described above. In one embodiment, the coefficient of friction for the interface of the high friction material 24 is about 8-10 times higher than the coefficient of friction of the interface of the low friction material 25. In another embodiment, the coefficient of friction for the interface of the high friction material 24 is between 5 and 10 times higher, or at least 5 times higher, than the coefficient of friction of the interface of the low friction material 25. It is understood that the coefficient of friction for the interface could be modified to at least some degree by modifying factors other than the sheet 20. For example, a high-friction substance or surface treatment may be applied to the bottom surface 44 of the pad 40, to increase the coefficient of friction of the interface. An example of a calculation of the coefficients of friction for these interfaces is described below, including a rip-stop nylon material as the low friction material 25 and a warp knit tricot material that was brushed, napped, and/or sanded and treated with a hot melt adhesive as the high friction material 24.

EXAMPLE

A 20"×20" section of bed linen (60% cotton, 40% polyester, 200 threads/inch) was taped without slack to a table top. A 10"×10" section of blue ripstop nylon was placed on top of the section of bed linen, then a 5 lb., 8" diameter weight was centered on top of the ripstop nylon. A force gauge (Extech 475044, 44 lb.max, digital) was attached to the ripstop nylon and was used to pull/slide the weighted ripstop nylon across the surface of the bed linen. The peak force to slide was recorded. Similarly, a 20"×20" section of tricot (warp knit tricot material that was brushed, napped, and/or sanded and treated with a hot melt adhesive) was taped without slack to a table top. A 10"×10" section of an absorbent body pad was placed on top of the section of the tricot material (patient side facing up), then the 5 lb., 8" diameter weight was centered on top of the body pad. The force gauge was attached to the body pad and was used to pull/slide the weighted body pad across the surface of the tricot material. The peak force to slide was recorded. The table below illustrates the results.

| Data | Pull Force (lb) to Induce Sliding (Material A/Material B) | |
|---|---|---|
| Point | Ripstop Nylon/Bed Linen | Body Pad/Tricot Material |
| 1 | 1.68 | 13.74 |
| 2 | 1.56 | 13.85 |
| 3 | 1.50 | 12.91 |
| 4 | 1.43 | 12.86 |
| 5 | 1.55 | 13.14 |
| 6 | 1.67 | 12.63 |
| Ave | 1.57 | 13.19 |
| SD | 0.10 | 0.50 |

As illustrated by the above data, the average pulling force required was approximately 8.4 times greater for the underpad-tricot interface than for the ripstop nylon-bed linen interface. Dividing the average required pull force by the 5 lb normal force gives a coefficient of friction for the interface of ripstop nylon-bed linen of 0.314 and a coefficient of friction for the interface of underpad-tricot of 2.638, which is approximately 8.4 times higher than the coefficient of friction for the ripstop nylon-bed linen interface.

In the embodiment of FIGS. 1-6, the sheet 20 also includes an elongated tether strap 30 connected to the sheet 20 and extending from the sheet 20 to connect to the bed 10 to secure the sheet 20 in place. As shown in FIG. 6, the tether strap 30 is connected to the top edge 23 of the sheet 20 and extends to connect the strap 30 to the head 13 of the bed 12, such as by connection to a fastener on the bed 12. The system 10 can also include a fastener strip 36 that is connectable to the bed 12, to provide a fastener for connecting the tether strap 30 to the bed 12. The strip 36 may be connected to the bed frame 14, such as by adhesive or similar technique as shown in FIG. 6, or to another part of the bed 12, such as to the mattress 18. In one embodiment, where the head 13 of the bed 12 can be raised and lowered, the strip 36 is connected to a portion of the bed frame 14 that raises and lowers with the head 13, so the strap 30 does not need to be disconnected in order to raise the head 13. Additionally, the strip 36 may be connectable to the strap 30 by a releasable connecting structure, such as a hook-and-loop connection (e.g. Velcro). In another embodiment, the strap 30 may be connected to the bed frame 14 or other part of the bed 12 by a different configuration, including ties, snaps, buckles, adhesives, or other releasable or non-releasable fastener configurations.

The strap 30 may be made from a single piece or multiple pieces. In the embodiment of FIGS. 1-6, the strap 30 includes an elastic portion 32 that is flexible and stretchable and a non-elastic portion 34 that has little to no stretchability. The elastic portion 32 may be made from a variable force elastic material that allows initial stretching for a distance (e.g. 2-3 inches) and then provides increased resistance to stretching. The elastic and non-elastic portions 32, 34 each form a portion of the length of the strap 30, as shown in FIGS. 1-3 and 6, and are connected at proximate ends. The portions 32, 34 can be connected by a releasable connection, such as a hook-and-loop connecting structure, as well as other types of releasable or non-releasable connections. As shown in FIGS. 1-3 and 6, the elastic portion 32 is stitched to the sheet 20, and the non-elastic portion 34 is connected to the free end of the elastic portion 32 and is configured for connection to the bed 12. In one embodiment, the non-elastic portion is formed of a material that is able to constitute a loop structure for hook-and-loop connection, allowing the non-elastic portion 34 to be connected at both ends to the elastic portion 32 and the strip 36 by hook-and-loop connections. Once connected to the bed 12, the strap 30 resists or prevents the sheet 20 from sliding downward, particularly when the head 13 of the bed 12 is inclined. The elastic portion 32 provides for slight freedom of movement in this situation, and in one embodiment, allows for approximately 2-3 inches of stretching and 2-3 inches of resultant movement of the sheet 20. Further, the releasable connection between the elastic portion 32 and the non-elastic portion 34 permits easier disconnection of the tether strap 30 for circumstances in which it is necessary to disconnect the strap 30 to move or reposition the patient, as the strip 36 may be difficult to access, depending on the position of the bed 12. In other embodiments, the strap 30 may contain additional pieces, and may have a different configuration or be connected to a different part of the sheet 20. In a further embodiment, the sheet 20 may have multiple tether straps 30 connected thereto, which can provide more secure connection to the bed 12 and/or greater options for connection.

The sheet 20 may also include one or more handles 28 to facilitate pulling, lifting, and moving the sheet 20. As shown in FIGS. 2-3, the sheet 20 has handles 28 formed by strips 29 of a strong material that are stitched in periodic fashion to the bottom surface 22 at or around opposite edges 23 of the sheet 20. The non-stitched portions can be separated slightly from the sheet 20 to allow a user's hands 76 to slip underneath, and thereby form the handles 28, as shown in FIG. 3. Other types of handles may be utilized in other embodiments.

In further embodiments, the sheet 20 and the components thereof may have different configurations, such as being made of different materials or having different shapes and relative sizes. For example, in one embodiment, the low-friction material 25 and the high-friction material 24 may be made out of pieces of the same size. In another embodiment, the low-friction material 25 and the high-friction material 24 may be part of a single piece that has a portion that is processed or treated to create a surface with a different coefficient of friction. As an example, a single sheet of material could be treated with a non-stick coating or other low-friction coating or surface treatment on one side, and/or an adhesive or other high-friction coating or surface treatment on the other side. Still other embodiments are contemplated within the scope of the invention.

In an alternate embodiment, the sheet 20 may not utilize a high friction surface, and instead may utilize a releasable connection to secure the pad 40 in place with respect to the sheet 20. For example, the sheet 20 and pad 40 may include complementary connections, such as hook-and-loop connectors, buttons, snaps, or other connectors. In another alternate embodiment, the sheet 20 may not utilize a strap 30, and may resist sliding in another way. In a further embodiment, the sheet 20 may be used without a pad 40, with the patient directly in contact with the top surface 21 of the sheet, and the high-friction material 24 can still resist sliding of the patient on the sheet 20.

The body pad 40 is typically made from a different material than the sheet 20 and contains an absorbent material, along with possibly other materials as well. The pad 40 provides a resting surface for the patient, and can absorb fluids that may be generated by the patient. The pad 40 may also be a low-lint pad, for less risk of wound contamination, and is typically disposable and replaceable, such as when soiled. The top and bottom surfaces 42, 44 may have the same or different coefficients of friction. Additionally, the pad 40 illustrated in the embodiments of FIGS. 1 and 6 is approximately the same size as the sheet 20, and both the sheet 20 and the pad 40 are approximately the same width as the bed 12 so that the edges 23 of the sheet 20 and the edges of the pad 40 are proximate the side edges of the bed 12, but may be a different size in other embodiments.

In one embodiment, the pad 40 may form an effective barrier to fluid passage on one side, in order to prevent the sheet 20 from being soiled, and may also be breathable, in order to permit flow of air, heat, and moisture vapor away from the patient and lessen the risk of pressure ulcers (bed sores). The sheet 20 may also be breathable to perform the same function, as described above. A breathable sheet 20 used in conjunction with a breathable pad 40 can also benefit from use with a LAL bed 12, to allow air, heat, and moisture vapor to flow away from the patient more effectively, and to enable creation of an optimal microclimate around the patient. FIG. 10*c* illustrates the breathability of the sheet 20 and the pad 40. The pad 40 may have differently configured top and bottom surfaces 42, 44, with the top surface 42 being configured for contact with the patient and the bottom surface 44 being configured for contact with the sheet 20.

The system 10 may include one or more wedges 50 that can be positioned under the sheet 20 to provide a ramp and support to slide and position the patient slightly on his/her side, as described below. FIGS. 4-5 illustrate an example embodiment of a wedge 50 that can be used in conjunction with the system 10. The wedge 50 has a body 56 that can be triangular in shape, having a base wall or base surface 51, a ramp surface 52 that is positioned at an oblique angle to the base wall 51, a back wall 53, and side walls 54. In this embodiment, the base wall 51 and the ramp surface 52 meet at an oblique angle to form an apex 55, and the back wall 53 is positioned opposite the apex 55 and approximately perpendicular to the ramp surface 52. The side walls 54 in this embodiment are triangular in shape and join at approximately perpendicular angles to the base wall 51, the ramp surface 52, and the back wall 53. In this embodiment, the surfaces 51, 52, 53, 54 of the wedge body 56 are all approximately planar when not subjected to stress, but in other embodiments, one or more of the surfaces 51, 52, 53, 54 may be curved or rounded. Any of the edges between the surfaces 51, 52, 53, 54 of the wedge body 56 may likewise be curved or rounded, including the apex 55.

The wedge body 56 in this embodiment is at least somewhat compressible, in order to provide greater patient comfort and ease of use. Any appropriate compressible material may be used for the wedge body 56, including various polymer foam materials, such as a polyethylene and/or polyether foam. A particular compressible material may be selected for its specific firmness and/or compressibility, and in one embodiment, the wedge body 56 is made of a foam that has relatively uniform compressibility.

The wedge 50 is configured to be positioned under the sheet 20 and the patient, to position the patient at an angle, as described in greater detail below. In this position, the base wall 51 of the wedge 50 faces downward and engages or confronts the supporting surface 16 of the bed 12, and the ramp surface 52 faces toward the sheet 20 and the patient and partially supports at least a portion of the weight of the patient. The angle of the apex 55 between the base wall 51 and the ramp surface 52 influences the angle at which the patient is positioned when the wedge 50 is used. In one embodiment, the angle between the base wall 51 and the ramp surface 52 may be up to 45°, or between 15° and 35° in another embodiment, or about 30° in a further embodiment. Positioning a patient at an angle of approximately 30° is clinically recommended, and thus, a wedge 50 having an angle of approximately 30° may be the most effective for use in positioning most immobile patients. The wedge 50 may be constructed with a different angle as desired in other embodiments. It is understood that the sheet 20 may be usable without the wedges 50, or with another type of wedge, including any commercially available wedges, or with pillows in a traditional manner. For example, the sheet 20 may be usable with a single wedge 50 having a greater length, or a number of smaller wedges 50, rather than two wedges 50, in one embodiment. As another example, two wedges 50 may be connected together by a narrow bridge section or similar structure in another embodiment. It is also understood that the wedge(s) 50 may have utility for positioning a patient independently and apart from the sheet 20 or other components of the system 10, and may be used in different positions and locations than those described and illustrated herein.

In the embodiment illustrated in FIGS. 4-5, the wedge 50 has a high-friction or gripping material 57 positioned on the base wall 51 and a low-friction or sliding material 58 positioned on the ramp surface 52. The high-friction material 57 and the low-friction material 58 may be any material described above with respect to the sheet 20, and in one embodiment, the high-friction material 57 and the low-friction material 58 of the wedge 50 may be the same as the high-friction material 24 and the low-friction material 25 of the sheet 20. The materials 57, 58 are connected to the wedge body 56 using an adhesive in the embodiment shown in FIGS. 1-6, and other connection techniques can be used in other embodiments. In this embodiment, the high-friction material 57 resists sliding of the wedge 50 along the supporting surface 16 of the bed 12 once in position under the patient, and the low-friction material 58 eases insertion of the wedge under the sheet 20 and the patient (over or beneath a bed sheet 15) and eases movement of the patient up the ramp surface 52 as described below and shown in FIG. 10*b*. As shown in FIG. 5, the low-friction material 58 is wrapped partially around the apex 55 in this embodiment, in order to ease insertion of the wedge 50 and resist separation or delamination of the materials 57, 58 from the wedge body 56 upon inserting the wedge 50.

Figure 7A:
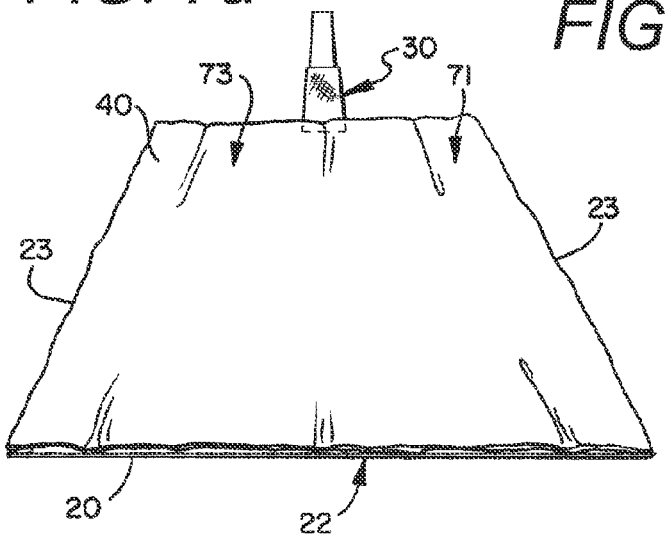
FIGS. 7*a-f* are a sequential series of views illustrating the flexible sheet of FIG. 1 being folded and packaged.
Figure 7B:
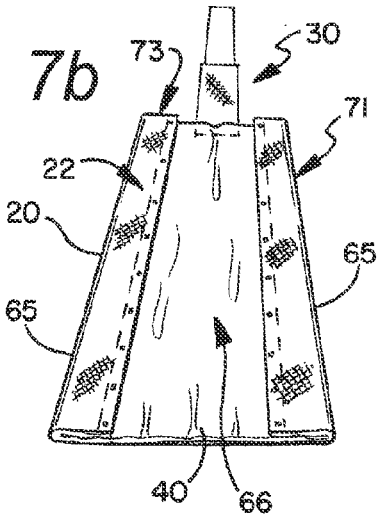
Figure 7C:
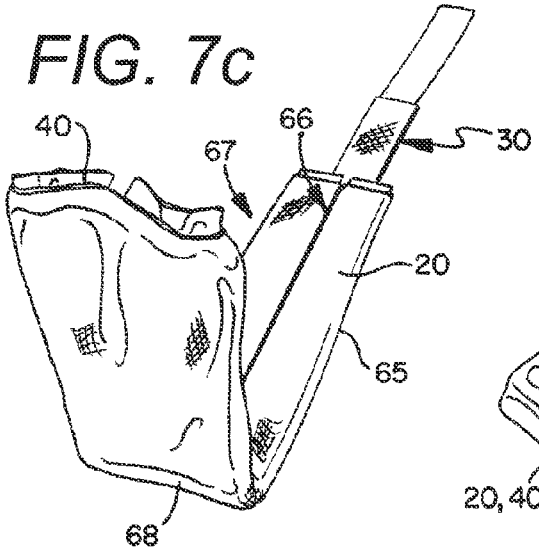
Figure 7D:
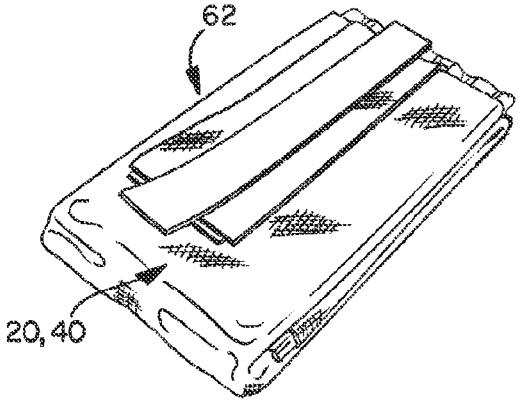
Figure 7E:
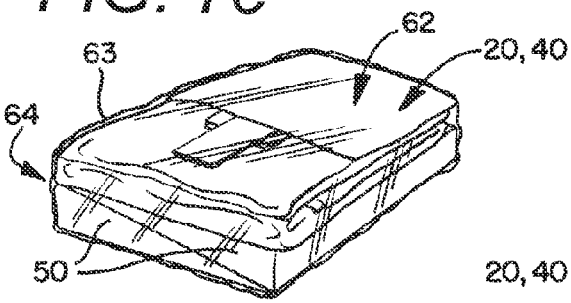
Figure 7F:
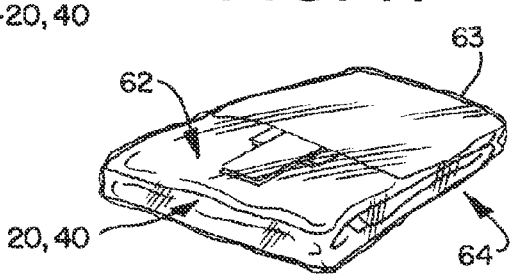

All or some of the components of the system 10 can be provided in a kit 60, which may be in a pre-packaged arrangement, as illustrated in FIGS. 7*a-f*. For example, the sheet 20 and the pad 40 may be provided in a pre-folded arrangement or assembly 62, as illustrated in FIG. 7*a*. In this arrangement, the pad 40 is positioned in confronting relation with the top surface 21 of the sheet 20, in approximately the same position that they would be positioned in use, and the sheet 20 and pad 40 can be pre-folded to form the pre-folded assembly 62, as illustrated in FIGS. 7*a-d*. It is understood that different folding patterns can be used instead of the folding arrangement pictured. The pre-folded sheet 20 and pad 40 can then be unfolded together on the bed 12, as described below, in order to facilitate use of the system 10. Additionally, the sheet 20 and the pad 40 can be packaged together, by wrapping with a packaging material 63 to form a package 64, and may be placed in the pre-folded assembly 62 before packaging. The one or more wedges 50 may also be included in the package 64, as illustrated in FIG. 7*e*. In the embodiment shown in FIG. 7*e*, two wedges 50 may be packaged together separately before insertion into the package 64, and may be vacuum-packed as well as being compressed, prior to or during packaging, in order to reduce the amount of space occupied. The wedges 50 illustrated in FIGS. 1-6 may be arranged for packaging so that their base walls 51 confront each other, to achieve optimum space utilization. FIG. 7*f* illustrates a package 64 including only the pre-folded assembly 62 of the sheet 20 and the pad 40, without the wedge(s) 50.

In one embodiment, the sheet 20 and pad 40 are folded together to provide ease in unfolding and placing the sheet 20 and pad 40 under the patient. For example, the sheet 20 and pad 40 can first be folded width-wise along a plurality of length-wise fold lines 65, as shown in FIG. 7*b*. In this embodiment, two opposed sides 71, 73 of the sheet 20 and pad 40 are folded inward toward the center 66 of the sheet 20 and pad 40 by folding from the left and right edges 23 of the sheet inwardly along the plurality of length-wise fold lines 65, as shown in FIG. 7*b*. When both sides 71, 73 of the sheet 20 and pad 40 are folded to the center 66, a narrow, width-wise folded arrangement 67 is created, as shown in FIG. 7*c*. This width-wise folded arrangement 67 is then folded length-wise along at least one width-wise fold line 68, as also shown in FIG. 7*c*. This creates the pre-folded assembly 62, which can then be packaged, stored, etc. The pre-folded assembly 62 can be unfolded in the reverse of the order described above. For example, the pre-folded assembly 62 can first be unfolded length-wise by unfolding along the at least one width-wise fold line 68 to create the narrow, width-wise folded arrangement 67. Then, the sheet 20 and pad 40 can be unfolded width-wise by unfolding away from the center 66 along the plurality of length-wise fold lines 65. As described below and shown in FIG. 8, the two sides 71, 73 of the sheet 20 and pad 40 may be unfolded sequentially, to assist in placing the sheet 20 and pad 40 under the patient 70, as described below.

Exemplary embodiments of methods for utilizing the system 10 are illustrated in FIGS. 8-10. FIGS. 8*a-d* illustrate an example embodiment of a method for placing the sheet 20 and pad 40 under a patient 70, which utilizes a pre-folded assembly 62 of the sheet 20 and pad 40, such as illustrated in FIGS. 7*a-d*. The method is used with a patient 70 lying on a bed 12 as described above, and begins with the sheet 20 and pad 40 unfolded length-wise in a partially-folded configuration similar to the configuration shown in FIG. 7*b* or 7*c*. In one embodiment, the sheet 20 and pad 40 may be unfolded along one or more width-wise fold lines, as described above, to create the width-wise folded arrangement 67, as illustrated in FIG. 7*c*. As shown in FIG. 8*a*, the patient 70 is rolled to one side, and the pre-folded assembly 62 is placed proximate the patient 70, so that a first side 71 of the assembly 62 is ready for unfolding, and the second side 73 is bunched under and against the back of the patient 70. The sheet 20 and pad 40 should be properly positioned at this time, to avoid the necessity of properly positioning the sheet 20 and pad 40 after the patient 70 is lying on top of them. In this embodiment, the sheet 20 is properly positioned when the tether strap 30 is positioned on the side closest to the head 13 of the bed 12, and the top edge 23 of the sheet 20 is about even with the shoulders of the patient 70, with the patient 70 positioned with his/her sacral area at the joint 72 where the bed 12 inclines (see FIG. 8*d*). In another embodiment, the sheet 20 may have an indicator (not shown), such as a visible line or other mark, for use in positioning the sheet 20 and/or the patient 70. For example, the sheet 20 may have a mark that is configured to be aligned with a marker (not shown) on the bed 12, which marker may be aligned with where the patient's sacral area should be positioned, such as at the joint 72 in the bed 12. The pad 40 is properly positioned in the pre-folded assembly 62, but may require positioning relative to the sheet 20 if the pad 40 is instead provided separately.

Figure 8A:
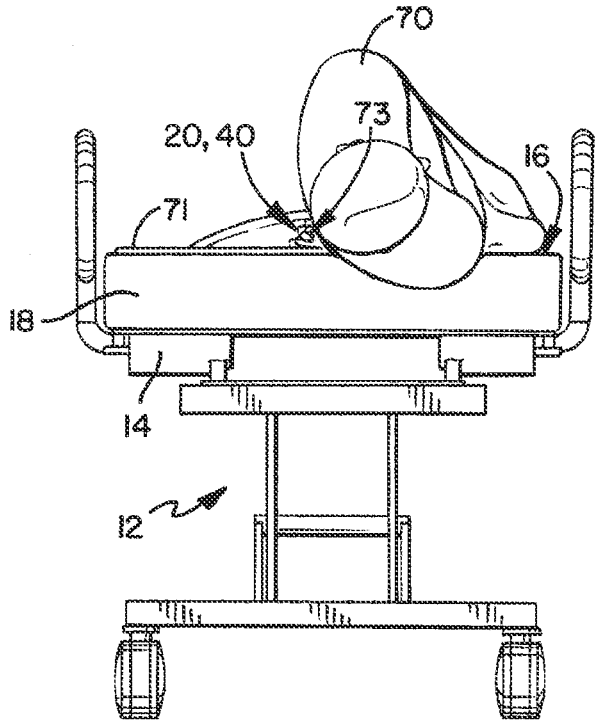
FIGS. 8*a-d* are a sequential series of views illustrating a method of placing the flexible sheet and an absorbent pad of the system of FIG. 1 on a bed.
Figure 8B:
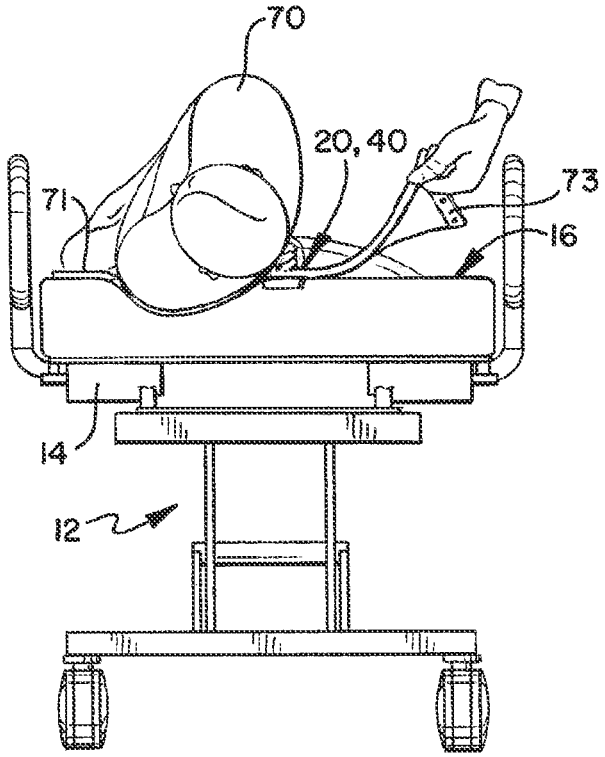
Figure 8C:
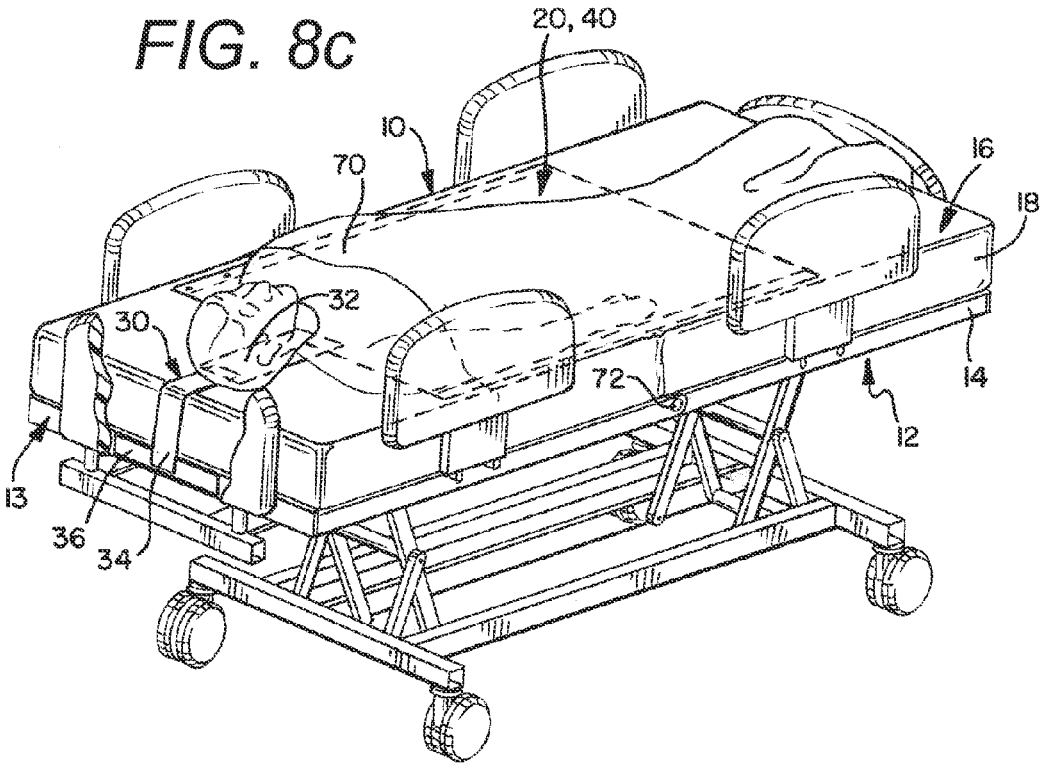
Figure 8D:
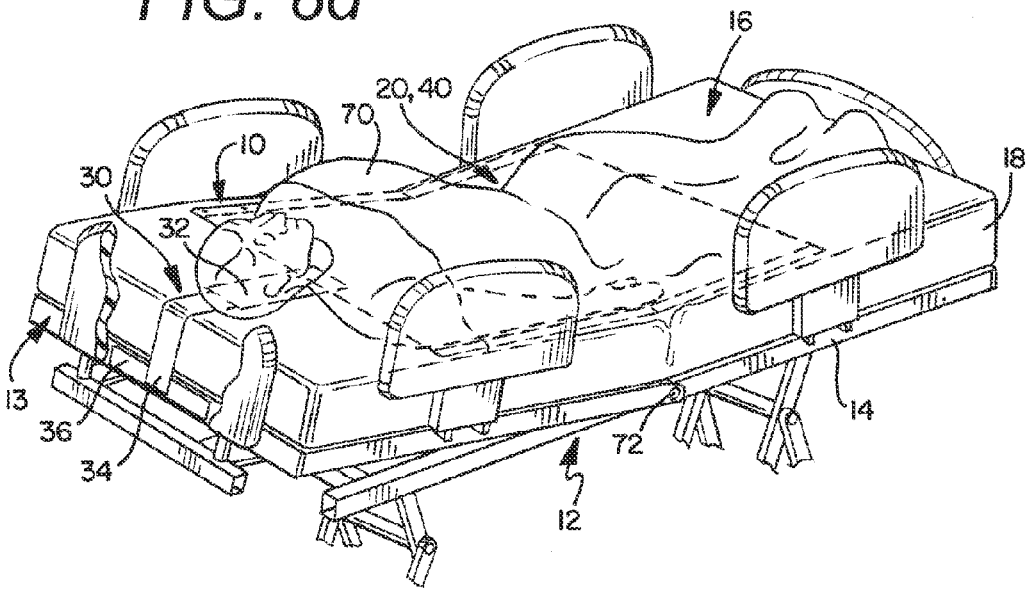

After positioning the second side 73 of the sheet 20 and pad 40 under or proximate the patient's back, the first side 71 of the sheet 20 and pad 40 assembly 62 (on the left in FIGS. 8*a-b*) is unfolded onto the bed 12. This creates a folded portion 75 that is bunched under the patient 70 and an unfolded portion 76 that is unfolded on the bed 12. The patient 70 is then rolled in the opposite direction, so that the second side 73 of the sheet 20 and pad 40 can be unfolded on the bed 12, as shown in FIG. 8*b*. If the sheet 20 and pad 40 are provided in the width-wise folded arrangement 67, as discussed above and shown in FIG. 7*c*, the first and second sides 71, 73 of the sheet 20 and pad 40 can be unfolded away from the center 66, by unfolding along the plurality of length-wise fold lines 65, as shown in FIG. 7*b*. The patient 70 can then be rolled onto his/her back on top of the sheet 20 and pad 40, and the tether strap 30 can be connected to the bed 12, such as by the strip 36 as shown in FIG. 8*c*. If the head 13 of the bed 12 is desired to be raised, as shown in FIG. 8*d*, then the strap 30 can be connected to the strip 36 after raising the head 13 of the bed 12, to allow for proper positioning of the patient before connecting the strap 30. In another embodiment, the strap 30 can be connected to the strip 36 before raising the head 13 of the bed 12. The patient 70 may be moved slightly to ensure proper positioning before connecting the strap 30, such as moving the patient 70 upward or toward the head of the bed 12, which can be accomplished by sliding the sheet 20 using the handles 28. The method illustrated in FIGS. 8*a-d* typically requires two or more caregivers for performance, but is less physically stressful and time consuming for the caregivers than existing methods.

Figure 9B:
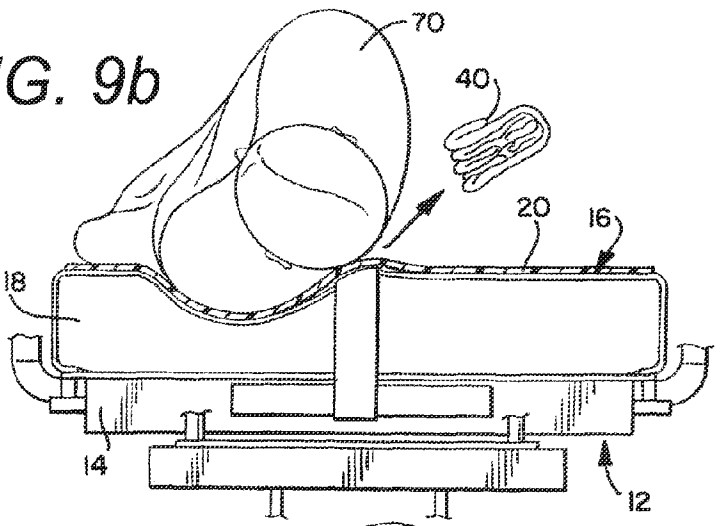
FIGS. 9*a-d* are a sequential series of views illustrating a method of removing and replacing the absorbent pad of FIGS. 8*a-d* on the bed.
Figure 9A:
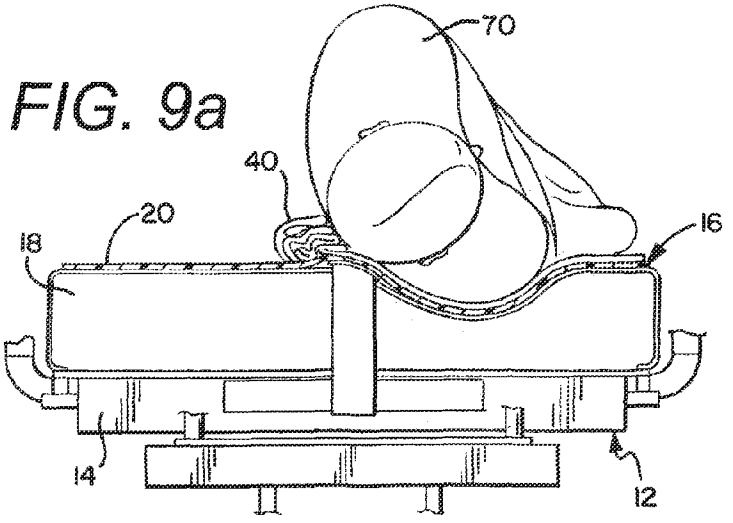
Figure 9D:
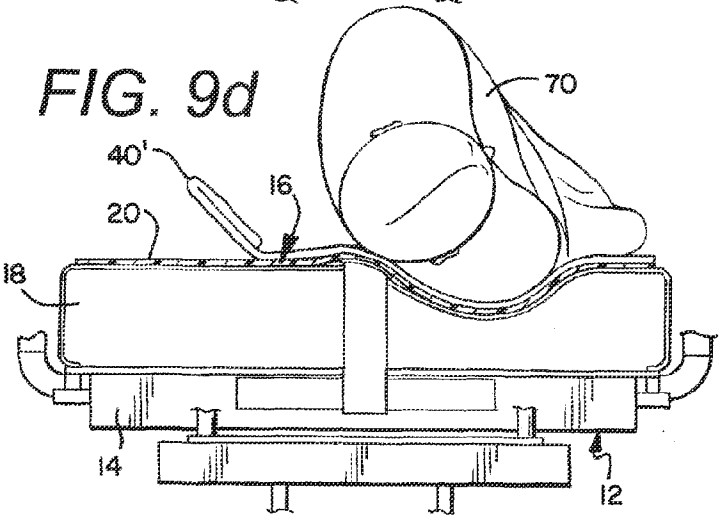
Figure 9C:
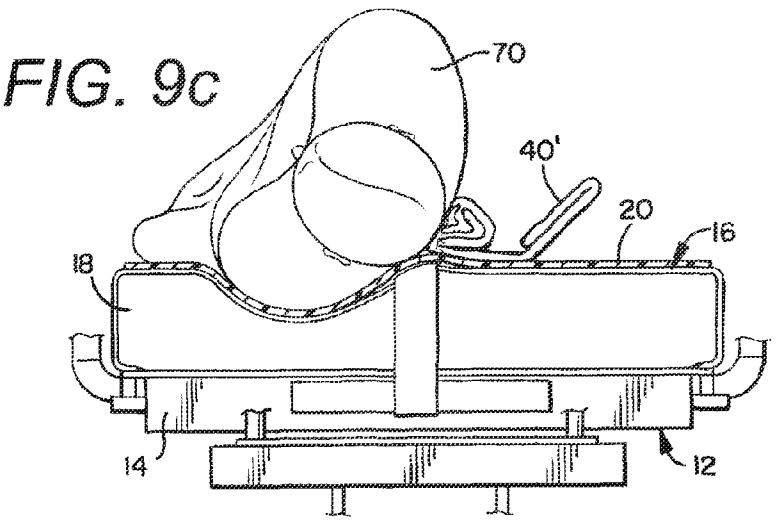

FIGS. 9*a-d* illustrate an example embodiment of a method for removing and replacing the pad 40, while the sheet 20 remains under the patient 70. The method is used with a patient 70 lying on a bed 12 as described above. As shown in FIG. 9*a*, the patient 70 is first rolled to one side, and the uncovered portion of the pad 40 can be rolled or folded up. Then, as shown in FIG. 9*b*, the patient 70 can be rolled the opposite direction, and the pad 40 can be removed. A new pad 40' can then be positioned under the patient and partially unfolded, similarly to the unfolding of the pre-folded assembly 62, as shown in FIG. 9*c*. Next, the patient 70 is rolled again to allow for complete unfolding of the pad 40', as shown in FIG. 9*d*, after which the patient 70 can be returned to his/her back. In one embodiment, the new pad 40' can be unrolled immediately following the rolling up of the old pad 40, before the patient is turned, thus requiring the patient 70 to only be turned two times instead of three. The method illustrated in FIGS. 9*a-d* typically requires two caregivers for performance, but is less physically stressful and time consuming for the caregivers than existing methods.

FIGS. 10*a-c* illustrate an example embodiment of a method for placing the patient in an angled resting position by placing two wedges 50 under the patient 70. The method is used with a patient 70 lying on a bed 12 as described above, having a bed sheet 15 on the supporting surface 16, with the sheet 20 and pad 40 of the system 10 lying on top of the bed sheet 15 and the patient 70 lying on the pad 40. In this embodiment, the wedges 50 are positioned under the bed sheet 15 (shown as a fitted sheet), so that the bed sheet 15 is between the ramp surface 52 of the wedge 50 and the sheet 20, and the base wall 51 of the wedge 50 is in contact with the mattress 18. In another embodiment, the wedges 50 may be positioned directly under the sheet 20 and over the bed sheet 15, to be in contact with the bottom surface 22 of the sheet 20. It is understood that no bed sheet 15 or other cover for the mattress 18 may be present in some embodiments, in which case the wedges 50 can be placed directly under the sheet 20. As shown in FIG. 10*a*, the edge of the bed sheet 15 is lifted, and the wedges 50 are inserted from the side of the bed 12 under the bed sheet 15 and the sheet 20 toward the patient 70. At this point, at least the apex 55 of each wedge 50 may be pushed toward, next to, or at least partially under the patient 70. The low friction material 58 of the wedge 50 can facilitate such insertion. In one embodiment, the wedges 50 should be aligned so that the wedges are spaced apart with one wedge 50 positioned at the upper body of the patient 70 and the other wedge 50 positioned at the lower body of the patient 70, with the patient's sacral area positioned in the space between the wedges 50. It has been shown that positioning the wedges 50 in this arrangement can result in lower pressure in the sacral area, which can reduce the occurrence of pressure ulcers in the patient 70. The greatest comfort was reported when the wedges 50 were positioned approximately 10 cm apart.

Once the wedges 50 have been inserted, the user 74 (such as a caregiver) can pull the patient 70 toward the wedge 70 and toward the user 74, such as by gripping the handles 28 on the sheet 20, as shown in FIG. 10*b*. This moves the proximate edge of the sheet 20 toward the back walls 53 of the wedges 50 and toward the user 74, and slides the patient 70 and at least a portion of the sheet 20 up the ramp surface 52, such that the ramp surface 52 partially supports the patient 70 to cause the patient 70 to lie in an angled position. During this pulling motion, the low friction materials 25, 58 on the sheet 20 and the wedges 50 provide ease of motion, the high friction surface 57 of the wedge 50 resists movement of the wedge 50, and the high friction surface 24 of the sheet 20 resists movement of the pad 40 and/or the patient 70 with respect to the sheet 20. Additionally, the elastic portion 32 of the strap 30 permits some freedom of movement of the sheet 20.

When the patient 70 is to be returned to lying on his/her back, the wedges 50 can be removed from under the patient 70. The sheet 20 may be pulled in the opposite direction in order to facilitate removal of the wedges 50 and/or position the patient 70 closer to the center of the bed 12. The patient can be turned in the opposite direction by inserting the wedges 50 under the opposite side of the bed sheet 15, from the opposite side of the bed 12, and pulling the sheet 20 in the opposite direction to move the patient 70 up the ramp surfaces 52 of the wedges 50, in the same manner described above.

As described above, in some embodiments, the wedges 50 may have an angle of up to approximately 45°, or from approximately 15-35°, or approximately 30°. Thus, when these embodiments of wedges 50 are used in connection with the method as shown in FIGS. 10*a-c*, the patient 70 need not be rotated or angled more than 45°, 35°, or 30°, depending on the wedge 50 configuration. The degree of rotation can be determined by the rotation or angle from the horizontal (supine) position of a line extending through the shoulders of the patient 70. Existing methods of turning and positioning patients to relieve sacral pressure often require rolling a patient to 90° or more to insert pillows or other supporting devices underneath. Rolling patients to these great angles can cause stress and destabilize some patients, particularly in patients with critical illnesses or injuries, and some critical patients cannot be rolled to such great angles, making turning of the patient difficult. Accordingly, the system 10 and method described above can have a positive effect on patient health and comfort. Additionally, the angled nature of the wedges 50 can allow for more accurate positioning of the patient 70 to a given resting angle, as compared to existing, imprecise techniques such as using pillows for support. For example, the recommended resting angle of 30° can be more successfully achieved with a wedge 50 that has an angle of approximately 30°, and the high friction material 57 on the base wall 51 resists sliding of the wedge 50 and aids in maintaining the same turning angle. Pillows, as currently used, provide inconsistent support and can slip out from underneath a patient more easily.

Research has shown that the use of the system 10 and methods described above can result in a significantly decreased number of pressure ulcers in patients. The system 10 reduces pressure ulcers in a variety of manners, including reducing pressure on sensitive areas, reducing shearing and friction on the patient's skin, and managing heat and moisture at the patient's skin. The system 10 can reduce pressure on the patient's skin by facilitating frequent turning of the patient and providing consistent support for accurate resting angles for the patient upon turning. The system 10 can reduce friction and shearing on the patient's skin by resisting sliding of the patient along the bed 12, including resisting sliding of the patient downward after the head 13 of the bed 12 is inclined, as well as by permitting the patient to be moved by sliding the sheet 20 against the bed 12 instead of sliding the patient. The system 10 can provide effective heat and moisture management for the patient by the use of the absorbent body pad. The breathable properties of the sheet 20 and pad 40, are particularly beneficial when used in conjunction with an LAL bed system. When used properly, pressure ulcers can be further reduced or eliminated. For example, in trials where the system 10 was used for 1000 patients, no pressure ulcers were reported, whereas typically about 7% to 20% of patients develop pressure ulcers.

The use of the system 10 and methods described above can also have beneficial effects for nurses or other caregivers who turn and position patients. Such caregivers frequently report injuries to the hands, wrists, shoulders, back, and other areas that are incurred due to the weight of patients they are moving. Use of the system 10, including the sheet 20 and the wedges 50, can reduce the strain on caregivers when turning and positioning patients. For example, existing methods for turning and positioning a patient 70, such as methods including the use of a folded-up bed sheet for moving the patient 70, typically utilize lifting and rolling to move the patient 70, rather than sliding. Protocols for these existing techniques encourage lifting to move the patient and actively discourage sliding the patient, as sliding the patient using existing systems and apparatuses can cause friction and shearing on the patient's skin. The ease of motion and reduction in shearing and friction forces on the patient 70 provided by the system 10 allows sliding of the patient 70, which greatly reduces stress and fatigue on caregivers.

As another example, the use of the pre-folded assembly 62 of the sheet 20 and pad 40, as shown in FIG. 7, facilitates installation of the system 10, such as in FIGS. 8*a-d*, providing an advantage for caregivers. The interaction between the sheet 20 and pad 40, including the high friction material 24 of the sheet 20, as well as the simultaneous unfolding of the sheet 20 and pad 40, also help avoid wrinkles in the sheet 20 and/or the pad 40, which can cause pressure points that lead to pressure ulcers.

As another example, the act of pulling and sliding the sheet 20 and patient 70 toward the caregiver 74 to turn the patient 70 to an angled position, as shown in FIG. 10*b*, creates an ergonomically favorable position for movement, which does not put excessive stress on the caregiver 74. In particular, the caregiver 74 does not need to lift the patient 70 at all, and may turn the patient 70 simply by pulling on the handles 28 to allow the mechanical advantage of the ramp surface 52 to turn the patient 70. Additionally, it allows the patient 70 to be turned between the angled and non-angled positions (e.g. 30°-0°-30°) by only a single caregiver. Prior methods often require two or more caregivers. Research data indicates that utilizing the system 10, including the sheet 20, the pad 40, and the wedges 50 as shown in FIG. 10 requires between 54% and 84% less work (depending on the type of bed and material of the bed sheet), with an average of 71% less work, to turn the patient, as compared to the current standard technique of sliding the patient 70 to the middle of the bed on a folded flat sheet, rolling the patient 70, inserting pillows under the patient 70, and then rolling the patient 70 back onto the pillows. For subjects weighing approximately 136 lb., between 43% and 66% less work (average 57% less) was required. For subjects weighing approximately 200 lb., between 61 and 78% less work (average 6% less) was required. For subjects weighing approximately 336 lb., between 55% and 94% less work (average 79% less) was required. Additional research data indicates that 93% of over 100 nurses surveyed reported greater compliance with Q2 turning protocols when using the sheet 20 and wedges 50 as described above and shown in FIGS. 10*a-c*. This high level of increased compliance was unexpected, and illustrates the advantages of the system 10 and methods described above for caregivers in ergonomics, time savings, and other areas. Further research, in the form of anecdotal evidence, indicates that using the system 10 makes turning and positioning the patient easier and results in significantly less stress on the caregiver, to an unexpectedly successful level. The anecdotal evidence also indicated that strong compliance with turning protocols was more likely while using the system 10, reinforcing the research data previously mentioned.

As further examples, the low friction material 25 on the bottom surface 22 of the sheet 20 facilitates all movement of the patient 70 on the bed 12, and additionally, the high friction material 24 on the sheet 20 reduces movement of the patient 70 and the use of the tether strap 30 reduces or eliminates sliding of the patient 70 when the bed is inclined, thereby reducing the necessity for the caregiver to reposition the patient 70. Still other benefits and advantages over existing technology are provided by the system 10 and methods described herein, and those skilled in the art will recognize such benefits and advantages.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "top," "bottom," etc., as used herein, are intended for illustrative purposes only and do not limit the embodiments in any way. Additionally, the term "plurality," as used herein, indicates any number greater than one, either disjunctively or conjunctively, as necessary, up to an infinite number. Further, "providing" an article or apparatus, as used herein, refers broadly to making the article available or accessible for future actions to be performed on the article, and does not connote that the party providing the article has manufactured, produced, or supplied the article or that the party providing the article has ownership or control of the article. Accordingly, while specific embodiments have been illustrated and described, numerous modifications come to mind without significantly departing from the spirit of the invention and the scope of protection is only limited by the scope of the accompanying Claims.

What is claimed is:

1. A method comprising:

providing a bed comprising a frame and a mattress supported by the frame, the bed having a head, a foot, and first and second opposed sides, and wherein the bed is configured such that the head of the bed can be raised to place the bed in an inclined position and lowered to place the bed in a flat position;

placing a sheet over a supporting surface of the mattress such that a top edge of the sheet is most proximate the head of the bed, a first edge of the sheet is most proximate the first side of the bed, and a second edge of the sheet is most proximate the second side of the bed, the sheet having a bottom surface that is placed to confront the supporting surface, and a top surface opposite the bottom surface, wherein the bottom surface is at least partially formed of a first material having a first coefficient of friction, and the top surface is at least partially formed of a second material having a second coefficient of friction, and wherein the second coefficient of friction is higher than the first coefficient of friction such that the top surface provides greater slipping resistance than the bottom surface, the sheet further comprising strips of material connected to the sheet and extending along opposed first and second edges of the sheet, wherein the strips form a plurality of handles positioned along the first edge and a plurality of handles positioned along the second edge, and a tether strap connected proximate the top edge of the sheet and extending from the top edge of the sheet;

positioning a patient on the bed, such that the patient rests above the supporting surface and the sheet;

attaching the tether strap to the head of the bed, wherein the tether strap is attached to a portion of the bed that is configured to raise and lower with the head, wherein the tether strap comprises a first portion and a second portion that each form portions of a length of the tether strap, such that the first portion is non-elastic, connects to a fastener connected to the portion of the bed and extends from the bed to the second portion, and the second portion is elastic and extends from the first portion to the sheet;

raising the head of the bed to place the bed in the inclined position, thereby inclining an upper body of the patient, wherein the tether strap moves with the head of the bed when the head is raised, and wherein the tether strap limits movement of the sheet with the patient thereon; and sliding the sheet toward the first side of the bed by grasping and pulling on one or more of the handles along the first edge of the sheet, without disconnecting the tether strap from the bed, wherein the elastic portion of the tether strap is configured to permit sliding of the sheet toward the first side of the bed without disconnecting the tether strap from the bed.

2. The method of claim 1, further comprising:

placing a wedge at least partially under the sheet and at least partially under the patient, the wedge having a base wall, a ramp surface positioned at an angle to the base wall to form an apex, and a back wall opposite the apex, by inserting the apex of the wedge under the first edge of the sheet from the first side of the bed such that the base wall confronts the supporting surface of the mattress, the ramp surface confronts the sheet, and the patient is supported by the ramp surface to cause the patient to lie in an angled position.

3. The method of claim 2, wherein the ramp surface is at least partially formed of a third material having a third coefficient of friction and the base wall is at least partially formed of a fourth material having a fourth coefficient of friction that is higher than the third coefficient of friction, such that the base wall resists sliding of the wedge with respect to the supporting surface due to the higher fourth coefficient of friction, and wherein the third coefficient of friction is also lower than the second coefficient of friction of the second material such that the bottom surface of the sheet and the ramp surface of the wedge form a low-friction interface.

4. The method of claim 2, wherein when the patient is lying in the angled position, the patient is rotated between approximately 20 and 30 degrees from a horizontal position.

5. The method of claim 2, further comprising:

removing the wedge from underneath the first edge of the sheet; and placing the wedge at least partially under the sheet and at least partially under the patient by inserting the apex of the wedge under the second edge of the sheet from the second side of the bed such that the base wall confronts the supporting surface of the mattress, the ramp surface confronts the sheet, and the patient is supported by the ramp surface to cause the patient to lie in a second angled position.

6. The method of claim 2, wherein the wedge is placed under a bed sheet covering the supporting surface of the mattress, the bed sheet being located between the mattress and the sheet, by inserting the apex under a first edge of the bed sheet from the first side of the bed such that the base wall contacts the supporting surface of the mattress and the ramp surface contacts the bed sheet.

7. The method of claim 1, further comprising:

placing an absorbent pad into contact with the top surface of the sheet such that at least a portion of the patient rests on the absorbent pad.

8. The method of claim 1, further comprising:

attaching a fastener strip to the portion of the bed that is configured to raise and lower with the head, the fastener strip having an adhesive portion and a hook-and-loop connecting structure, wherein the fastener strip is attached to the bed by the adhesive portion; and connecting the tether strap to the fastener strip to connect the tether strap to the bed, wherein the tether strap comprises a complementary hook-and-loop connecting structure, and wherein the tether strap is connected to the fastener strip by connecting the hook-and-loop connecting structures of the tether strap and the fastener strip.

9. The method of claim 1, wherein the first material is formed as a first piece of sheet material forming the bottom surface of the sheet, and the second material is connected to the first piece of sheet material and forms at least a majority portion of the top surface.

10. The method of claim 9, wherein the second material is recessed from at least one edge of the sheet, such that the first material forms a portion of the top surface.

11. The method of claim 1, wherein the first portion has a first connecting structure connecting the tether strap to the bed, and the second portion has a second connecting structure connecting the tether strap to the sheet.

12. A system for use with a bed comprising a frame and a mattress supported by the frame, the mattress having a supporting surface, the bed having a head, a foot, and first and second opposed sides, and wherein the bed is configured such that the head of the bed can be raised to place the bed in an inclined position and lowered to place the bed in a flat position, the system comprising:

a sheet configured to be positioned over the supporting surface of the mattress such that a top edge of the sheet is most proximate the head of the bed, a first edge of the sheet is most proximate the first side of the bed, and a second edge of the sheet is most proximate the second side of the bed, the sheet having a bottom surface configured to confront the supporting surface, and a top surface opposite the bottom surface, wherein the bottom surface is at least partially formed of a first material having a first coefficient of friction, and the top surface is at least partially formed of a second material having a second coefficient of friction, and wherein the second coefficient of friction is higher than the first coefficient of friction such that the top surface is configured to provide greater slipping resistance than the bottom surface; and first and second strips of material connected to the sheet and extending along opposed first and second edges of the sheet, wherein the first strip forms a plurality of handles positioned along the first edge and the second strip forms a plurality of handles positioned along the second edge;

a tether strap connected to the sheet proximate the top edge of the sheet and extending from the top edge of the sheet, wherein the tether strap is configured to be connected to the bed at a portion of the bed that is configured to raise and lower with the head, wherein the tether strap further comprises a first portion and a second portion that each form portions of a length of the tether strap, such that the first portion is non-elastic, is attached to a fastener configured to be connected to the bed and extends from the bed to the second portion, and the second portion is elastic and extends from the first portion to the sheet, and wherein the elastic portion of the tether strap is configured to permit sliding of the sheet toward the first side of the bed by grasping and pulling on one or more of the handles along the first edge of the sheet, without disconnecting the tether strap from the bed.

13. The system of claim 12, further comprising:

a wedge having a base wall, a ramp surface positioned at an angle to the base wall to form an apex, and a back wall opposite the apex, wherein the wedge is configured to be placed at least partially under the sheet by inserting the apex of the wedge under the first edge of the sheet from the first side of the bed such that the base wall confronts the supporting surface of the mattress and the ramp surface confronts the sheet.

14. The system of claim 13, wherein the ramp surface is at least partially formed of a third material having a third coefficient of friction and the base wall is at least partially formed of a fourth material having a fourth coefficient of friction that is higher than the third coefficient of friction, such that the base wall is configured to resist sliding of the wedge with respect to the supporting surface due to the higher fourth coefficient of friction, and wherein the third coefficient of friction is also lower than the second coefficient of friction of the second material such that the bottom surface of the sheet and the ramp surface of the wedge form a low-friction interface.

15. The system of claim 12, further comprising:

an absorbent pad configured to be positioned on top of the top surface of the sheet, wherein the high friction surface is configured to resist sliding of the absorbent pad with respect to the top surface of the sheet.

16. The system of claim 12, further comprising:

a fastener strip having an adhesive portion and a hook-and-loop connecting structure, wherein the fastener strip is configured to be attached to the bed by the adhesive portion, wherein the tether strap comprises a complementary hook-and-loop connecting structure, and wherein the tether strap is configured to be connected to the fastener strip by connecting the hook-and-loop connecting structures of the tether strap and the fastener strip.

17. The system of claim 12, wherein the first material is formed as a first piece of sheet material forming the bottom surface of the sheet, and the second material is connected to the first piece of sheet material and forms at least a majority portion of the top surface.

18. The system of claim 17, wherein the second material is recessed from at least one edge of the sheet, such that the first material forms a portion of the top surface.

19. The method of claim 12, wherein the first portion has a first connecting structure connecting the tether strap to the bed, and the second portion has a second connecting structure connecting the tether strap to the sheet.

20. A method comprising:

providing a bed comprising a frame and a mattress supported by the frame, the bed having a head, a foot, and first and second opposed sides, and wherein the bed is configured such that the head of the bed can be raised to place the bed in an inclined position and lowered to place the bed in a flat position;

positioning a patient on the bed, such that the patient rests above a supporting surface of the mattress;

providing a sheet and an absorbent pad that is separate and removable from the sheet together in a pre-folded assembly, the sheet having a top edge and opposed first and second side edges, the sheet further having opposed top and bottom surfaces, wherein the bottom surface is at least partially formed of a first material having a first coefficient of friction, and the top surface is at least partially formed of a second material having a second coefficient of friction, and wherein the second coefficient of friction is higher than the first coefficient of friction such that the top surface provides greater slipping resistance than the bottom surface;

placing the sheet and the absorbent pad on the bed and simultaneously unfolding the sheet and the absorbent pad by unfolding the pre-folded assembly beneath the patient, including:

rolling the patient toward the second side of the bed;

placing the sheet and absorbent pad proximate the patient in the form of the pre-folded assembly;

unfolding the first side edge of the sheet and a portion of the absorbent pad toward the first side of the bed to create an unfolded portion of the sheet and absorbent pad;

rolling the patient toward the first side of the bed and onto the unfolded portion;

unfolding the second side edge of the sheet and the absorbent pad toward the second side of the bed to completely unfold the sheet and the absorbent pad; and rolling the patient to a horizontal position on top of the sheet and the absorbent pad, wherein the sheet is positioned over the supporting surface of the mattress such that the top edge of the sheet is most proximate the head of the bed, the bottom surface confronts the supporting surface, and the absorbent pad is positioned in contact with the top surface of the sheet, such that the high friction surface resists sliding of the absorbent pad with respect to the top surface;

connecting the sheet to the bed using a tether strap, wherein the tether strap comprises an elastic portion and a non-elastic portion that each form a portion of a length of the tether strap, and wherein the elastic portion is connected at one end to the sheet and at another end to the non-elastic portion, and the non-elastic portion is attached to a fastener connected to the bed.

21. The method of claim 20, further comprising:

placing a wedge at least partially under the sheet and at least partially under the patient, the wedge having a base wall, a ramp surface positioned at an angle to the base wall to form an apex, and a back wall opposite the apex, by inserting the apex of the wedge under the first edge of the sheet from a first side of the bed such that the base wall confronts the supporting surface of the mattress, the ramp surface confronts the sheet, and the patient is supported by the ramp surface to cause the patient to lie in an angled position.

22. The method of claim 21, wherein the ramp surface is at least partially formed of a third material having a third coefficient of friction, wherein the third coefficient of friction is lower than the second coefficient of friction of the second material such that the bottom surface of the sheet and the ramp surface of the wedge form a low-friction interface.

23. The method of claim 20, further comprising removing the absorbent pad from the sheet and replacing the absorbent pad with a second absorbent pad without removing the sheet from the bed, such that the second absorbent pad is positioned in contact with the top surface of the sheet.

* * * * *